US008646859B2

(12) United States Patent
Sugiura

(10) Patent No.: US 8,646,859 B2
(45) Date of Patent: Feb. 11, 2014

(54) PRINTER SYSTEM, AND CONNECTABLE DEVICES AND PRINTER USED IN THE SAME

(75) Inventor: Shinta Sugiura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/597,783

(22) Filed: Aug. 29, 2012

(65) Prior Publication Data

US 2013/0050307 A1 Feb. 28, 2013

(30) Foreign Application Priority Data

Aug. 31, 2011 (JP) ..... 2011-188710

(51) Int. Cl.
*B41J 29/38* (2006.01)

(52) U.S. Cl.
USPC ..... 347/5; 347/9; 347/12

(58) Field of Classification Search
USPC ..... 347/5, 9, 12, 14, 19, 40, 41
See application file for complete search history.

(56) References Cited

U.S. PATENT DOCUMENTS

| | | | | |
|---|---|---|---|---|
| 6,902,251 | B2 * | 6/2005 | Morikawa et al. | 347/40 |
| 7,377,607 | B2 * | 5/2008 | Sakamoto | 347/9 |
| 2005/0179750 | A1 | 8/2005 | Hayasaki et al. | |

FOREIGN PATENT DOCUMENTS

| | | | |
|---|---|---|---|
| JP | H03-154071 | A | 7/1991 |
| JP | 2001-324901 | A | 11/2001 |
| JP | 2005-205886 | A | 8/2005 |

* cited by examiner

*Primary Examiner* — Juanita D Jackson
(74) *Attorney, Agent, or Firm* — Baker Botts L.L.P.

(57) ABSTRACT

A printer-side controller of a printer repeats transmission of connection confirmation data while response data is received in response to the connection confirmation data. A device-side controller of the connectable device forward the connection confirmation data which is received after transmission of the response data to another connectable device connected thereto. Further, when the printer-side controller confirms connection with any of the plurality of connectable devices by receiving the response data, the device-side controller of the connectable device for which the connection is confirmed stores in the device-side identifier storage memory the identifier corresponding to the position of the connectable device, which is stored in the printer-side identifier storage memory of the printer.

15 Claims, 12 Drawing Sheets

PRINTER SYSTEM, AND CONNECTABLE DEVICES AND PRINTER USED IN THE SAME

CROSS REFERENCE TO RELATED APPLICATION

The present application claims priority from Japanese Patent Application No. 2011-188710, which was filed on Aug. 31, 2011, the disclosure of which is herein incorporated by reference in its entirety.

BACKGROUND OF THE INVENTION

1. Field of the Invention

The present invention relates to a printer system which enables connection of connectable devices to a printer, and relates to the connectable devices and the printer used in such a system.

2. Description of Related Art

Traditionally, there has been a printer system having a plurality of connectable devices connected to a printer, in which system the connectable devices are connected to the printer via the same line, thus reducing the number of lines between the printer and the connectable devices.

For example, in such a printer system, each of the connectable devices connected to a determined position is given a unique identifier in advance. When the printer controls a specific one of the connectable devices, control data indicative of content of the control and the identifier of that specific connectable device are transmitted to the connectable devices, thereby controlling only the specific connectable device.

SUMMARY OF THE INVENTION

In the above printer system, the plurality of connectable devices each having a common device function are connected to the printer serially in multiple stages (Daisy Chain connection). The content of the control by the printer relative to the connectable devices varies depending on the positional relationship between the printer and the control-targeted connectable device. The printer therefore needs to have information regarding the order of the connectable devices connected in multiple stages. To reduce the number of lines connecting the printer to the plurality of connectable devices, one approach is to determine in advance an alignment sequence of the connectable devices and have an identifier corresponding to the position in the alignment stored in each of the connectable devices.

With the above technology however, the position of each connectable device in the multiple stages is determined beforehand. The position of the connectable device is not changeable to any given position of the multiple stages. Therefore, the freedom of arranging connectable devices is low.

In view of the above, it is an object of the present embodiment to provide a printer system with improved freedom in arranging a plurality of connectable devices having a common device function dispose, and to provide connectable devices and a printer adoptable in such a system.

An aspect of the present invention is a printer system, comprising a printer and a plurality of connectable devices. The printer comprises: a printer-side connector configured to connect any of the connectable devices; a printer-side communication interface configured to communicate with the connectable devices; a printer-side identifier storage memory configured to store an identifier for each of the connectable devices and stage position information associated with the identifier, the stage position information being indicative of a position of one of the connectable devices with the corresponding identifier, in the plurality of connectable devices serially connected; and a printer-side controller. The connectable devices are serially connected to the printer in multiple stages. Each of the connectable devices has a common function and comprises: a device-side first connector configured to connect another one of the connectable devices; a device-side second connector configured to connect one of the printer-side connector and the device-side first connector of another connectable device; the device-side identifier storage memory configured to store the identifier; a device-side communication interface configured to communicate with the printer or another connectable device; and a device-side controller. The printer-side controller is configured so as to perform, as identifier associating process, the following process. The printer-side communication interface is controlled so as to repeat a printer-side connection confirmation data transmission process while a printer-side reception process is performed. The printer-side connection confirmation data transmission process is a process of transmitting, to the connectable devices via the printer-side connector, connection confirmation data for confirming a connection status with each of the connectable devices. The printer-side reception process is a process of receiving, via the printer-side connector, response data transmitted from the connectable devices in response to the printer-side connection confirmation data transmission process. The device-side controller is configured so as to perform, as the identifier associating process, the following process. The device-side communication interface is controlled so as to perform, after a device-side transmission process, a forwarding process of forwarding, to another connectable device via the device-side first connector, the connection confirmation data received through the device-side connection confirmation data reception process of receiving the connection confirmation data from the printer via the device-side second connector. The device-side transmission process is a process of transmitting the response data to the printer in response to the connection confirmation data. The printer-side controller and the device-side controller further are configured so as to perform, as the identifier associating process, the following process. When the printer-side controller confirms connection with any one of the connectable devices through the printer-side reception process, the printer-side controller stores in the printer-side identifier storage memory the identifier and the position of that connectable devices for which connection has been confirmed, or the device-side controller of the connectable device for which connection has been confirmed stores in its device-side identifier storage memory the identifier corresponding to the position of that connectable device, which is stored in the printer-side identifier storage memory of the printer.

Another aspect of the present invention is a printer for use in a printer system comprising the printer and a plurality of connectable devices having a common device function, which are serially connected to the printer in multiple stages. Each of the connectable devices comprises: a device-side first connector configured to connect another one of the connectable devices; a device-side second connector configured to connect one of a printer-side connector of the printer and the device-side first connector of another one of the connectable devices; a device-side identifier storage memory configured to store an identifier for each of the connectable devices; a device-side communication interface configured to perform a device-side connection confirmation data reception process of receiving, via the device-side second connector, connection confirmation data transmitted from the printer for confirming connection status between the printer and the connectable device, a device-side transmission process of transmitting response data to the printer in response to the connection confirmation data, a forwarding process of forwarding the connection confirmation data to another one of the connectable devices being connected via the device-side first connector; and a device-side controller, the device-side controller controlling the device-side communication interface so as to perform, as an identifier associating process, the forwarding process of the connection confirmation data received in the device-side connection confirmation data reception process after the device-side transmission process. The printer comprises: a printer-side communication interface configured to communicate with the connectable devices; a printer-side identifier storage memory configured to store the identifier for each of the connectable devices and stage position information associated with the identifier, the stage position information being indicative of a position of one of the connectable devices with the corresponding identifier, in the plurality of connectable devices serially connected; and a printer-side controller. The printer-side controller is configured so as to perform, as the identifier associating process, the following process. The printer-side communication interface is controlled so as to repeat a printer-side connection confirmation data transmission process while a printer-side reception process is performed. The printer-side connection confirmation data transmission process is a process of transmitting the connection confirmation data to the connectable device via the printer-side connector. The printer-side reception process is a process of receiving, via the printer-side connector, response data transmitted from the connectable devices in response to the printer-side connection confirmation data transmission process. When the printer-side controller confirms connection with any one of the connectable devices through the printer-side reception process, the printer-side controller stores in the printer-side identifier storage memory the identifier and the position of that connectable device for which connection has been confirmed.

Yet another aspect of the present invention is a connectable device for use in a printer system comprising a plurality of connectable devices and a printer capable of serially connecting thereto the connectable devices in multiple stages. The printer comprises: a printer-side connector configured to connect any of the connectable devices; a printer-side communication interface configured to perform a printer-side connection confirmation data transmission process of transmitting, to the connectable devices via the printer-side connector, connection confirmation data for confirming a connection status with each of the connectable devices, and a printer-side reception process of receiving, via the printer-side connector, response data transmitted from the connectable devices in response to the printer-side connection confirmation data transmission process; a printer-side identifier storage memory configured to store an identifier for each of the connectable devices and stage position information associated with the identifier, the stage position information being indicative of a position of one of the connectable devices with the corresponding identifier, in the plurality of connectable devices serially connected; and a printer-side controller, the printer-side controller controlling the printer-side communication interface, as the identifier associating process, so as to repeat the printer-side connection confirmation data transmission process while the printer-side reception process is performed, and when a connection with any one of the connectable devices is confirmed through the printer-side reception process, cause the printer-side identifier storage memory to store the identifier and the position of the connectable device for which the connection is confirmed. The connectable device has a common device function and, comprises: a device-side first connector configured to connect another one of the connectable devices; a device-side second connector configured to connect one of the printer-side connector and the device-side first connector of another connectable device; the device-side identifier storage memory configured to store the identifier; a device-side communication interface configured to communicate with the printer or another connectable device; and a device-side controller. The device-side controller is configured so as to perform, as an identifier associating process, the following process. The device-side controller controls the device-side communication interface so as to, after transmitting the response data to the printer in response to the connection confirmation data, forward the connection confirmation data received from the printer via the device-side second connector to another connectable device via the device-side first connector.

Still another aspect of the present invention is a printer system comprising a printer and a plurality of connectable devices serially connected to the printer in multiple stages. The printer comprises: a printer-side connector configured to connect any of the connectable devices; a printer-side communication interface configured to communicate with the connectable devices; a printer-side identifier storage memory configured to store an identifier for each of the connectable devices and stage position information associated with the identifier, the stage position information being indicative of a position of one of the connectable devices with the corresponding identifier, in the plurality of connectable devices serially connected; and a printer-side controller. Each of the connectable devices has a common function and comprises: a device-side first connector configured to connect another one of the connectable devices; a device-side second connector configured to connect one of the printer-side connector and the device-side first connector of another connectable device; a device-side identifier storage memory configured to store the identifier; a device-side communication interface configured to communicate with the printer or another connectable device; and a device-side controller. The printer-side controller is configured so as to perform, as an identifier associating process, the following process. The printer-side communication interface is controlled to perform a printer-side common permission data transmission process which transmits to one of the connectable devices via the printer-side connector common permission data which is common among the connectable devices having the common device function, after the printer-side common permission data transmission process is performed, the printer-side communication interface is controlled so as to repeat a printer-side connection confirmation data transmission process while a printer-side reception process is performed. The printer-side connection confirmation data transmission process is a process of transmitting, to all the connectable devices, connection confirmation data for confirming a connection status with each of the connectable devices. The printer-side reception process is a process of receiving response data transmitted from the connectable devices in response to the printer-side connection confirmation data transmission process. The device-side controller is configured so as to perform, as the identifier associating process, the following process. The device-side communication interface is controlled so as to perform a device-side connection confirmation data reception process of receiving the connection confirmation data from the printer. The device-side communication interface is controlled so as to perform a device-side common permission data reception process of receiving the common permission data via the device-side second connector. The device-side communication interface is controlled so that, if the common permission data has been already received in the device-side common permission data reception process at a time of receiving the connection confirmation data in the device-side connection confirmation data reception process, a device-side transmission process and a forwarding process are performed. The device-side transmission process is a process of transmitting the response data for the connection confirmation data to the printer, and the forwarding process is a process of transferring the common permission data to another one of the connectable devices connected via the device-side first connector are performed. The printer-side controller and the device-side controller are further configured so as to perform, as the identifier associating process, the following process. When the printer-side controller confirms connection with any one of the connectable devices through the printer-side reception process, the printer-side controller stores in the printer-side identifier storage memory the identifier and the position of that connectable devices for which connection has been confirmed, or the device-side controller of the connectable device for which connection has been confirmed stores in its device-side identifier storage memory the identifier corresponding to the position of that connectable device, which is stored in the printer-side identifier storage memory of the printer.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

<First Embodiment>

Figure 1:
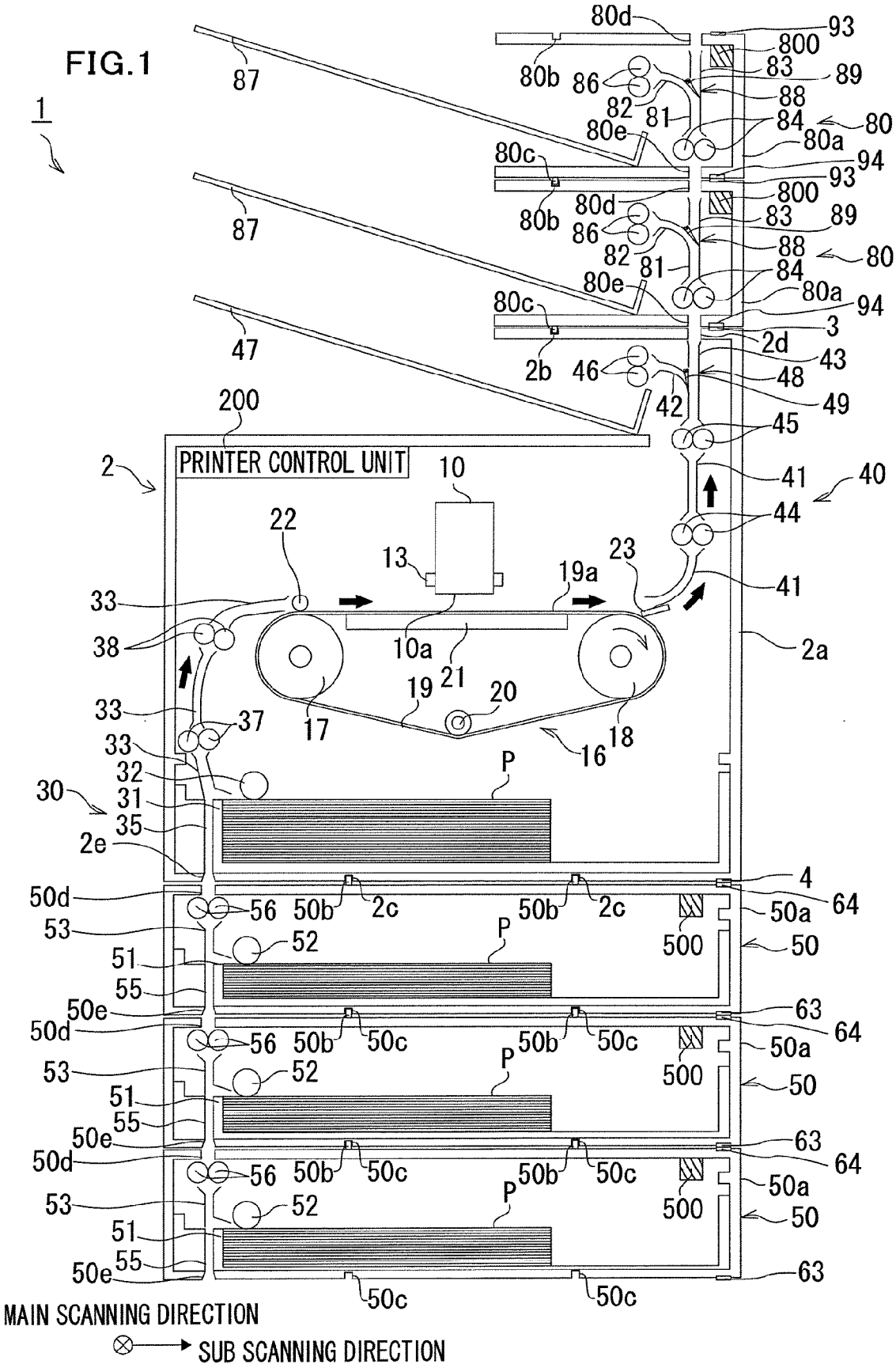
FIG. 1 is a schematic side view showing a mechanical structure of a printer system of the first embodiment.

As shown in FIG. 1, a printer system 1 related to a first embodiment is an inkjet printer system including: a printer 2 which records (forms) an image on a sheet P; and a plurality of extension paper-feeder devices 50 and a plurality of extension paper output devices 80 which are connectable devices detachable to/from the printer 2. The plurality of extension paper-feeder devices 50 are serially connected in multiple stages (a series of three stages in the present embodiment) to the printer 2. Each of the extension paper-feeder devices 50 is capable of feeding sheets P to the printer 2. Further, the plurality of extension paper output devices 80 are serially connected in multiple stages (a series of two stages in the present embodiment) to the printer 2. Each of the extension paper output devices 80 is capable of outputting the sheet P having been conveyed from the printer 2.

[Mechanical Structure of Printer]

As shown in FIG. 1, the printer 2 includes a printer casing 2*a* in a rectangular parallelepiped shape. In the inside space of the printer casing 2*a* are arranged: a conveyance unit 16 which conveys a sheet P in a conveyance direction (direction from the left to right of FIG. 1); an inkjet head 10 (hereinafter, simply referred to as head 10) which forms an image on a sheet P conveyed by the conveyance unit 16; a paper-feeder unit 30 which feeds a sheet P to the conveyance unit 16; a paper output unit 40 which outputs the sheet P having been subjected to image formation; and a printer control unit 200 which controls the operation of the entire printer 2.

Figure 2:
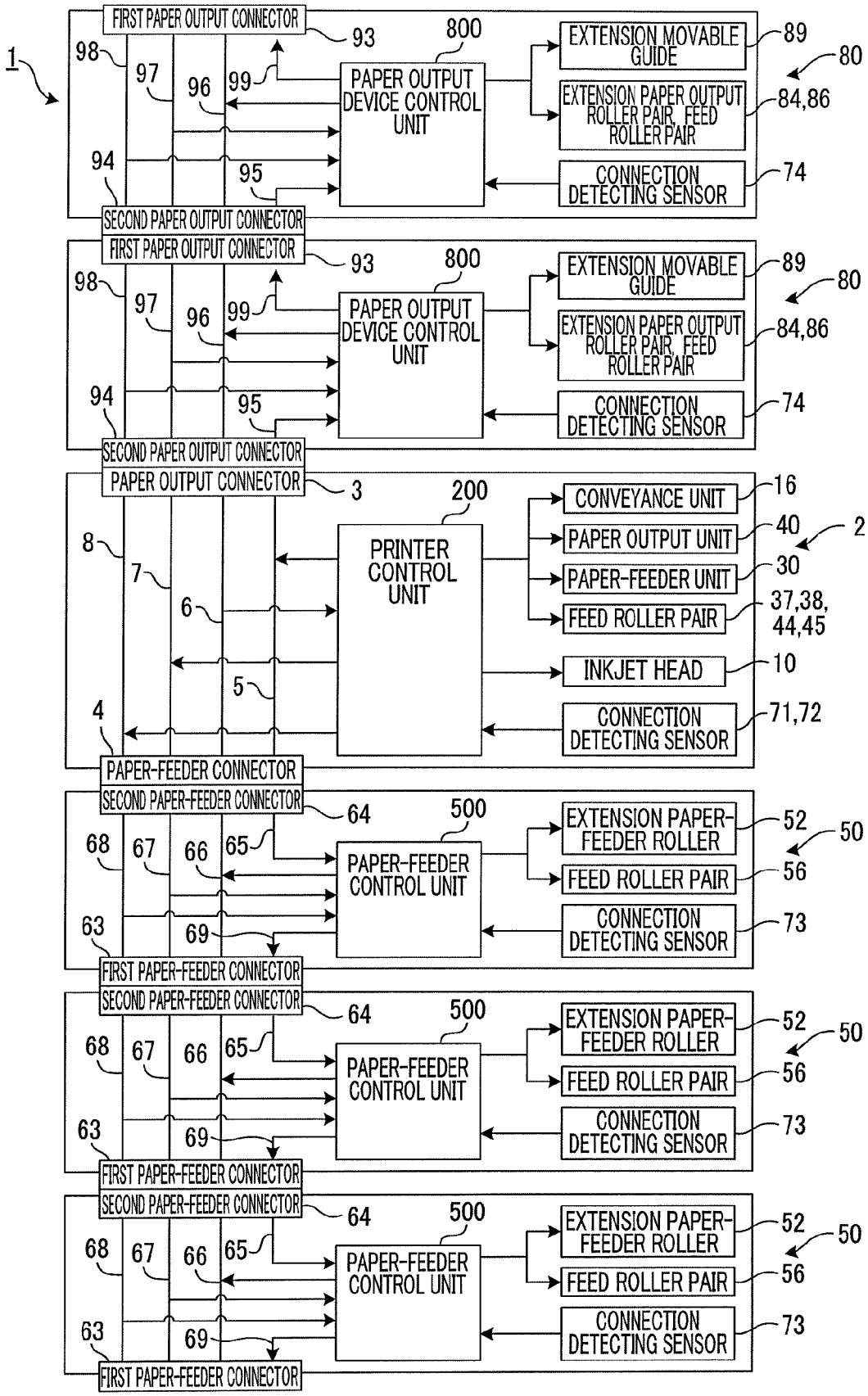
FIG. 2 is an electrical structure of the printer system shown in FIG. 1.

On top surface of the top board of the printer casing 2*a*, there is formed a positioning hole 2*b* for positioning an extension paper output device 80 to be connected in the first stage of the printer 2, and a paper output connector 3 (printer-side connector) connected to the printer control unit 200 via connection lines 5 to 8 (see FIG. 2). The connection lines 5 to 8 are signal lines connecting the paper output connector 3, a later-described paper-feeder connector 4 (printer-side connector), and a printer control unit 200 to one another. Connecting a second paper output connector 94 of the extension paper output device 80 to the paper output connector 3 enables communication between the printer control unit 200 and a paper output device control unit 800 of the extension paper output device 80 connected to the printer 2.

The connection line 5 is a common signal line through which the printer 2 transmits common permission data to the extension paper-feeder device 50 and the extension paper output device 80 each connected at the first stage of the printer 2. The connection line 6 is a signal line for receiving later-described response data and device data from the extension paper-feeder device 50 and the extension paper output device 80. The connection line 7 is a signal line through which the printer 2 transmits later-described connection confirmation data and command data to the extension paper-feeder device 50 and the extension paper output device 80. Further, the connection line 8 is a signal line through which the printer 2 transmits reset data to the extension paper-feeder device 50 and the extension paper output device 80. Note that the command data is data for causing the extension paper-feeder device 50 or the extension paper output device 80 to perform a specific process operation. The device data is data transmitted in addition to the response data from the extension paper-feeder device 50 or the extension paper output device 80 to the printer 2.

Meanwhile, on the bottom board of the printer casing 2*a*, there is formed a positioning hole 2*c* for positioning the extension paper-feeder device 50 to be connected in the first stage of the printer 2, and a paper-feeder connector 4 is connected to the printer control unit 200 via the connection lines 5 to 8. Connecting a later-described second paper-feeder connector 64 of the extension paper-feeder device 50 to the paper-feeder connector 4 enables communication between the printer control unit 200 and a later-described paper-feeder control unit 500 of each of the extension paper-feeder devices 50 serially connected in multiple stages to the printer 2. Note that the printer casing 2*a* is provided with a connection detecting sensor 71 (see FIG. 2) which detects connection status between a paper-feeder connector 4 and the second paper-feeder connector 64, and a connection detecting sensor 72 (see FIG. 2) which detects connection status between the paper output connector 3 and the second paper output connector 94. The connection detecting sensor 71 outputs a detection signal to the printer control unit 200 only when the paper-feeder connector 4 and the second paper-feeder connector 64 are connected to each other. The connection detecting sensor 72 outputs a detection signal to the printer control unit 200 only when the paper output connector 3 and the second paper output connector 94 are connected to each other.

Further, on the bottom board of the printer casing 2*a* is opened a sheet input port 2*e* which passes therethrough a sheet P supplied from an extension paper-feeder device 50 positioned below. On the top board of the printer casing 2*a* is opened a sheet output port 2*d* which outputs a sheet P to an extension paper output device 80 positioned above.

The paper-feeder unit 30 has a printer paper-feeder tray 31 and a printer paper-feeder roller 32 which are detachable and are attached to the printer casing 2*a* in the sub scanning direction. The printer paper-feeder tray 31 is a box whose top is opened, and accommodates a plurality of sheets P. The printer paper-feeder roller 32 sends out the uppermost one of the sheets P in the printer paper-feeder tray 31 to the later-described sheet conveyance path 33. Note that the sub scanning direction is a direction parallel to the conveyance direction in which the sheet P is conveyed by the conveyance unit 16. The main scanning direction is a direction perpendicular to the sub scanning direction, and parallel to the horizontal plane.

In the printer casing 2*a* is arranged a sheet conveyance path 33 extended from the printer paper-feeder roller 32 towards the conveyance unit 16. In the sheet conveyance path 33 are arranged a feed roller pair 37 and a feed roller pair 38 sequentially in this order from the upstream relative to the conveyance direction of the sheet P. Further, the paper-feeder unit 30 has a sheet conveyance path 35 which guides the sheet P sent from an extension paper-feeder device 50 positioned below to the sheet conveyance path 33. The sheet conveyance path 35 is extended from the sheet input port 2*e* to the sheet conveyance path 33.

With this structure, the sheet P fed by the printer paper-feeder roller 32 from the printer paper-feeder tray 31 to the sheet conveyance path 33, or the sheet P fed from the extension paper-feeder device 50 positioned below to the sheet conveyance path 33 via the sheet conveyance path 35 is successively sandwiched and conveyed to the conveyance unit 16 by the feed roller pair 37 and the feed roller pair 38, under control by the printer control unit 200.

The conveyance unit 16 includes: two belt rollers 17 and 18; a conveyor belt 19; a tension roller 20; a platen 21; a nip roller 22; and a separation plate 23. The conveyor belt 19 is an endless belt looped around the rollers 17 and 18, and a tension is given by the tension roller 20. The platen 21 is disposed to face the head 10, and supports the upper part of the loop formed by the conveyor belt 19. The belt roller 18 is a drive roller which rotates clockwise in FIG. 1, and runs the conveyor belt 19. The belt roller 17 is a driven roller which rotates as the conveyor belt 19 runs. On a conveyance face 19*a* of the conveyor belt 19 is formed a silicon layer which is slightly adhesive. The nip roller 22 presses against the conveyance face 19*a* the sheet P having conveyed from the printer paper-feeder tray 31 or the extension paper-feeder device 50, via the sheet conveyance path 33. The sheet P pressed is held by the silicon layer of the conveyor belt 19. The separation plate 23 separates the sheet P on the conveyor belt 19 from the conveyor belt 19.

The head 10 is a line head having a substantially rectangular parallelepiped shape longer in the main scanning direction. The under surface of the head 10 is an ejection face 10*a* having a number of ejection openings. Further, the head 10 is supported by the printer casing 2*a* via a head holder 13. The head holder 13 holds the head 10 so that a predetermined space suitable for image recording is formed between the ejection face 10*a* and the conveyance face 19*a* of the conveyor belt 19. When the sheet P conveyed by the conveyor belt 19 passes immediately under the head 10, black ink droplets are successively ejected from the head 10 to the upper surface of the sheet P, thus forming a desirable monochrome image on the sheet P. The sheet P having the image formed thereon is further conveyed towards right of the FIG. 1 by the conveyance unit 16, separated from the conveyor belt 19 by the separation plate 23, and fed to the later-described sheet conveyance path 41.

The paper output unit 40 has a printer paper output roller pair 46, a printer paper output tray 47, and a printer sorting mechanism 48. Further, in the printer casing 2*a* are disposed a sheet conveyance path 41 extending from the conveyance unit 16 to the printer sorting mechanism 48, a sheet conveyance path 42 extended from the printer sorting mechanism 48 to the printer paper output roller pair 46, and a sheet conveyance path 43 extended from the printer sorting mechanism 48 to the sheet output port 2*d*. In the sheet conveyance path 41 are disposed a feed roller pair 44 and a feed roller pair 45 sequentially in this order from the upstream of the conveyance direction of the sheet P. The printer sorting mechanism 48 has a movable guide 49, and controls the movable guide 49 to switch the destination of the sheet P conveyed through the sheet conveyance path 41 between the sheet conveyance path 42 and the sheet conveyance path 43.

In this structure, when the destination is set to the sheet conveyance path 42 by the movable guide 49, the sheet P passes through the sheet conveyance path 42 and is output to the printer paper output tray 47 by the printer paper output roller pair 46. On the other hand, when the destination is set to the sheet conveyance path 43 by the movable guide 49, the sheet P passes through the sheet conveyance path 43, and is output to the extension paper output device 80 positioned above.

[Mechanical Structure of Extension Paper-Feeder Device]

As shown in FIG. 1, the extension paper-feeder device 50 has an extension paper-feeder casing 50*a*. In the extension paper-feeder casing 50*a* are disposed an extension paper-feeder tray 51 detachably attached to the extension paper-feeder casing 50*a*, an extension paper-feeder roller 52, a paper-feeder control unit 500 which controls the entire operation of the extension paper-feeder device 50, and the like. The extension paper-feeder tray 51 is a box whose top is opened, and accommodates a plurality of sheets P as is the case of the printer paper-feeder tray 31. The extension paper-feeder roller 52 feeds the uppermost one of the sheets P in the extension paper-feeder tray 51 to the later-described sheet conveyance path 53.

On the under surface of the bottom board of the extension paper-feeder casing 50*a*, a first paper-feeder connector 63 (device-side first connector) is provided in a position corresponding to the paper-feeder connector 4 of the printer casing 2*a*, relative to any direction perpendicular to the up/down direction in FIG. 1. Further, on top of the top board of the extension paper-feeder casing 50*a* is provided a second paper-feeder connector 64 (device-side second connector)

which is connectable to the paper-feeder connector 4 of the printer 2 or the first paper-feeder connector 63 of another extension paper-feeder device 50. The first paper-feeder connector 63 is connected to the paper-feeder control unit 500 via the connection lines 66 to 69. The second paper-feeder connector 64 is connected to the paper-feeder control unit 500 via the connection lines 65 to 68. The connection lines 66 to 68 are signal lines mutually connecting the first paper-feeder connector 63, the second paper-feeder connector 64, and the paper-feeder control unit 500. The connection line 65 is a signal line only for connecting the second paper-feeder connector 64 to the paper-feeder control unit 500. The connection line 69 is a signal line only for connecting the first paper-feeder connector 63 to the paper-feeder control unit 500.

When the second paper-feeder connector 64 is connected to the paper-feeder connector 4 of the printer 2, the connection lines 65 to 68 are connected to the connection lines 5 to 8 of the printer 2, respectively. Likewise, when the second paper-feeder connector 64 is connected to the first paper-feeder connector 63 of another extension paper-feeder device 50, the connection lines 66 to 68 are connected to the connection lines 66 to 68 of the extension paper-feeder device 50, and the connection line 65 is connected to the connection line 69 of the other extension paper-feeder device 50.

This enables an extension paper-feeder device 50 of the second or any of the subsequent stages connected to the printer 2 to perform communications of various data such as connection confirmation data, response data, reset data, or the like with the printer 2 via the connection lines 66 to 68 of another extension paper-feeder device 50 of the previous stage. On the other hand, communications of later-described common permission data is performed only between the printer 2 and the extension paper-feeder device 50 of the first stage connected to the printer 2, or between adjacent extension paper-feeder devices 50. Note that the extension paper-feeder casing 50*a* is provided with a connection detecting sensor 73 (see FIG. 2) which detects connection status between the first paper-feeder connector 63 and the second paper-feeder connector 64 of another extension paper-feeder device 50. The connection detecting sensor 73 outputs a detection signal to the paper-feeder control unit 500 only when the first paper-feeder connector 63 is connected to the second paper-feeder connector 64 of the other extension paper-feeder device 50.

Further, the top board of the extension paper-feeder casing 50*a* has a sheet output port 50*d* which passes therethrough a sheet P to be fed to the printer 2 or an extension paper output device 80 positioned above, and the bottom board of the extension paper-feeder casing 50*a* has a sheet input port 50*e* which passes therethrough a sheet P fed from an extension paper-feeder device 50 positioned below.

Further, the extension paper-feeder device 50 is provided with a positioning hole 50*c* on the bottom board of the extension paper-feeder casing 50*a*, for positioning the other extension paper-feeder device 50 to be connected thereto. The positioning hole 50*c* is formed in a position corresponding to the position of the positioning hole 2*c* on the printer casing 2*a*, relative to any direction perpendicular to the up/down direction in FIG. 1. On the other hand, on top of the top board of the extension paper-feeder casing 50*a* is formed a positioning pin 50*b* corresponding to the positioning hole 50*c* and the positioning hole 2*c* of the printer 2.

The extension paper-feeder casing 50*a* is provided with a sheet conveyance path 53 extended from the extension paper-feeder roller 52 to the sheet output port 50*d*, and a sheet conveyance path 55 extended from the sheet input port 50*e* to the sheet conveyance path 53. In the sheet conveyance path 53 is disposed a feed roller pair 56. In this structure, under control by the paper-feeder control unit 500, a sheet P sent out by the extension paper-feeder roller 52 from the extension paper-feeder tray 51 to the sheet conveyance path 53, or a sheet P sent out from an extension paper-feeder device 50 positioned below to the sheet conveyance path 53 via the sheet conveyance path 55 is sandwiched and conveyed by the feed roller pair 56 to the sheet conveyance path 35 in the printer 2 positioned above or the sheet conveyance path 55 of an extension paper-feeder device 50 positioned above.

[Mechanical Structure of Extension Paper Output Device]

As shown in FIG. 1, each extension paper output device 80 has an extension paper output casing 80*a*. In the extension paper output casing 80*a* are disposed an extension paper output roller pair 86, an extension paper output tray 87, an extension sorting mechanism 88, a paper output device control unit 800 which controls the entire operation of the extension paper output device 80.

On top of the top board of the extension paper output casing 80*a* is provided a first paper output connector 93 (device-side first connector). The first paper output connector 93 is provided in a position corresponding to the position of the paper output connector 3 provided to the printer casing 2*a*, relative to any direction perpendicular to the up/down direction in FIG. 1. Further, on the under surface of the bottom board of the extension paper output casing 80*a* is provided a second paper output connector 94 (device-side second connector) connectable to the paper output connector 3 of the printer 2 or to the first paper output connector 93 of the extension paper output device. The first paper output connector 93 is connected to the paper output device control unit 800 via connection lines 96 to 99, and the second paper output connector 94 is connected to the paper-feeder control unit 500 via connection lines 95 to 98. Note that the structures of the first paper output connector 93, the second paper output connector 94, the connection lines 95 to 99 are substantially the same as those of the above-mentioned first paper-feeder connector 63, the second paper-feeder connector 64, and the connection lines 65 to 69. Therefore, the explanations for them are omitted.

On the top board of the extension paper output casing 80*a* is formed a sheet output port 80*d* which passes therethrough a sheet P to be output to an extension paper output device 80 positioned above. On the undersurface of the bottom board of the extension paper output casing 80*a* is formed a sheet input port 80*e* which passes therethrough a sheet P output from the printer 2 or an extension paper output device 80 positioned below. Further, the extension paper output casing 80*a* is provided with a connection detecting sensor 74 (see FIG. 2) which detects connection status between the first paper output connector 93 and the second paper output connector 94 of the other extension paper-feeder device 50. The connection detecting sensor 74 outputs a detection signal to the paper output device control unit 800 only when the first paper output connector 93 is connected to the second paper output connector 94 of the other extension paper-feeder device 50.

Further, the extension paper output device 80 has, on the top board of the extension paper output casing 80*a*, a positioning hole 80*b* for positioning another extension paper-feeder device 50 to be connected thereto. This positioning hole 80*b* is formed in a position corresponding to the position of the positioning hole 2*b* formed on the printer casing 2*a*, relative to any direction perpendicular to the up/down direction in FIG. 1. On the other hand, on the under surface of the bottom board of the extension paper output casing 80*a* is formed a positioning pin 80*c* to fit into the positioning hole 80*b* and the positioning hole 2*b* of and the printer 2.

Further, in the extension paper output casing 80*a* are disposed a sheet conveyance path 81 extended from the sheet input port 80*e* to the extension sorting mechanism 88; a sheet conveyance path 82 extended from the extension sorting mechanism 88 to the extension paper output roller pair 86; and a sheet conveyance path 83 extended from the extension sorting mechanism 88 to the sheet output port 80*d*. In the sheet conveyance path 81 is disposed a feed roller pair 84. The extension sorting mechanism 88 has an extension movable guide 89, and controls the extension movable guide 89 to switch the destination of the sheet P conveyed through the sheet conveyance path 81 between the sheet conveyance path 82 and the sheet conveyance path 83.

In this structure, when the destination is set to the sheet conveyance path 82 by the extension movable guide 89, the sheet P passes through the sheet conveyance path 82 and is output to the extension paper output tray 87 by the extension paper output roller pair 86. On the other hand, when the destination is set to the sheet conveyance path 83 by the extension movable guide 89, the sheet P passes through the sheet conveyance path 83, and is output to the extension paper output device 80 positioned above.

[Electric Structure of Printer]

Figure 3:
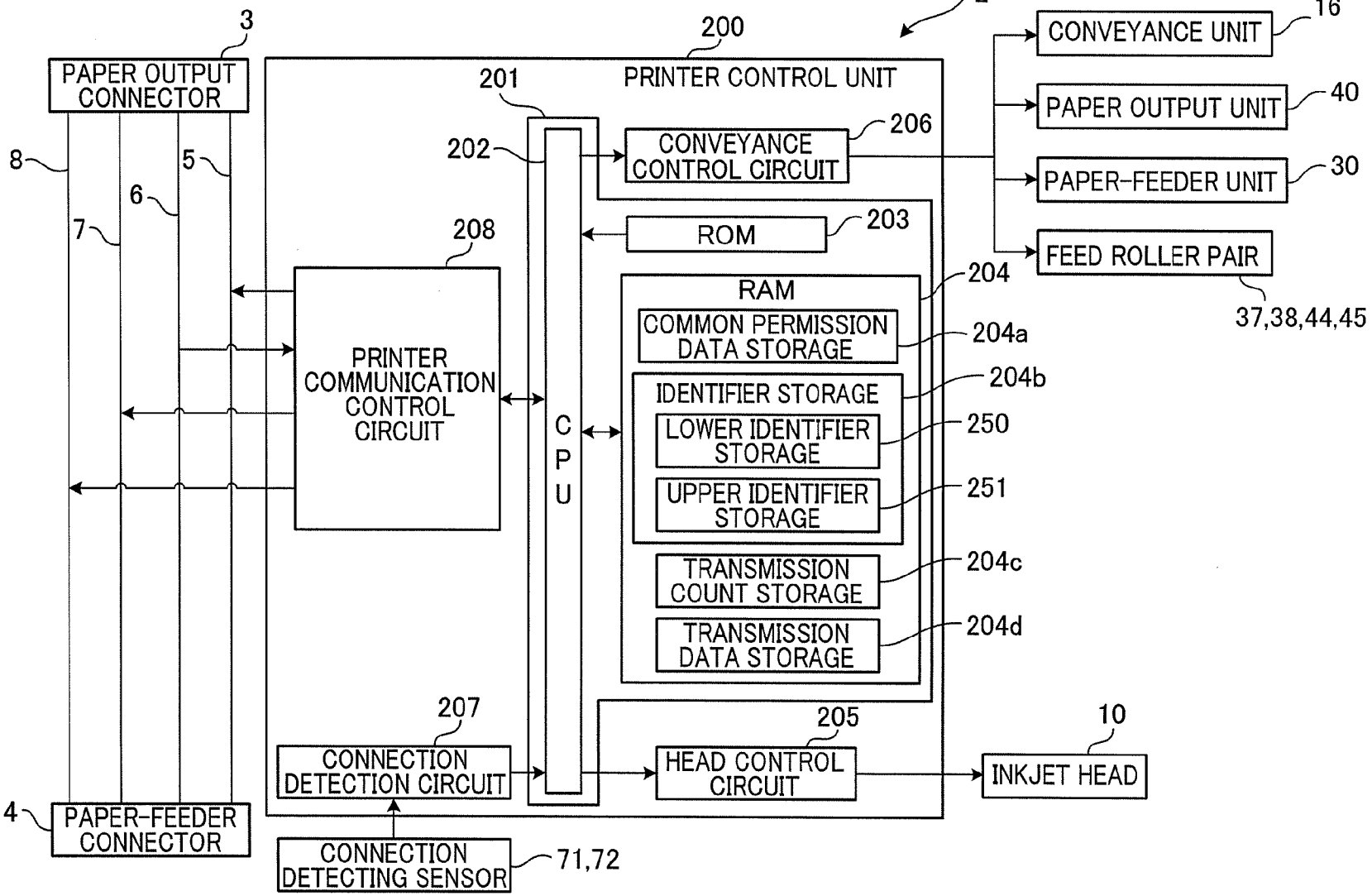
FIG. 3 is a diagram showing an electrical structure of a printer shown in FIG. 1.

As shown in FIG. 3, the printer 2 is controlled its operation by the printer control unit 200. The printer control unit 200 is mainly structured by a micro computer 201 disposed on a circuit board, and additionally includes various circuits. The micro computer 201 includes a CPU (Central Processing Unit) 202 (printer-side controller) which performs control based on a pre-set program; a ROM (Read Only Memory) 203, and a RAM (Random Access Memory) 204. The ROM 203 stores various programs to be run by the CPU 202.

The RAM 204 temporarily stores data, and includes a common permission data storage 204*a*, an identifier storage 204*b* (printer-side identifier storage memory), a transmission count storage 204*c*, and a transmission data storage 204*d*.

The common permission data storage 204*a* stores common permission data (hereinafter, paper-feeder common permission data) which is common among all the extension paper-feeder devices 50, and common permission data (hereinafter, paper-output common permission data) which is common among all the extension paper output devices 80. Further, the common permission data storage 204*a* also stores associated status indicative of whether or not the common permission data is yet to be transmitted or has been already transmitted in a later-mentioned printer-side identifier associating process. Note that the paper-feeder common permission data and the paper-output common permission data are different sets of data.

The identifier storage 204*b* has a lower identifier storage 250 corresponding to the paper-feeder common permission data, and an upper identifier storage 251 corresponding to the paper-output common permission data, stored in the common permission data storage 204*a*. The lower identifier storage 250 stores, in association with stage position information, an identifier assigned to each of the extension paper-feeder devices 50. The stage position information indicates, where among the multiple stages of extension paper-feeder devices 50 serially connected to the printer 2, the extension paper-feeder device 50 of the corresponding identifier is connected. The upper identifier storage 251 stores, in association with stage position information, an identifier assigned to each of the extension paper output devices 80. The stage position information indicates, where among the multiple stages of extension paper output devices 80 serially connected to the printer 2, the extension paper output device 80 of the corresponding identifier is connected.

The transmission count storage 204*c* stores a count n (where n is a natural number: hereinafter, also referred to as transmission count n) of a later-described printer-side connection confirmation data transmission process. The transmission count n is initially set to "1". Further, the transmission data storage 204*d* stores the common permission data most recently transmitted through the later-described printer-side common permission data transmission process.

Further, the CPU 202 is connected to and controls a head control circuit 205, a conveyance control circuit 206, a connection detection circuit 207, and a printer communication control circuit 208 (printer-side communication interface).

The head control circuit 205 controls the head 10 so as to cause ink ejection to a sheet P based on print data having been forwarded from a not-shown external apparatus such as a PC.

The conveyance control circuit 206 controls the conveyance unit 16, the feed roller pairs 37, 38, 44, 45, and the paper output unit 40 so that the sheet P is conveyed from the paper-feeder unit 30 to the paper output unit 40. Further, the conveyance control circuit 206, when outputting the sheet P to the printer paper output tray 47, controls the movable guide 49 so that the destination of the sheet P is set to the sheet conveyance path 42. The conveyance control circuit 206, when outputting the sheet P to any one of the extension paper output devices 80, controls the movable guide 49 so that the destination of the sheet P is set to the sheet conveyance path 43.

The connection detection circuit 207 receives detection signals from the connection detecting sensors 71, 72.

The printer communication control circuit 208 performs a printer-side connection confirmation data transmission process (hereinafter, connection confirmation data transmission process), a command transmission process, a reset data transmission process, a printer-side response data reception process (hereinafter, response data reception process), a device data reception process, and a common permission data transmission process. The connection confirmation data transmission process and the command transmission process are processes for outputting the connection confirmation data or the command data to the connection line 7, thereby transmitting the data to the extension paper-feeder device 50 and the extension paper output device 80. The reset data transmission process is a process of outputting the reset data to the connection line 8, thereby transmitting the reset data to the extension paper-feeder device 50 and the extension paper output device 80. Note that the data output to the connection line 7 or 8 by the printer communication control circuit 208 is transmitted to all the extension paper-feeder devices 50 via the paper-feeder connector 4, and to all the extension paper output devices 80 via the paper output connector 3.

Further, the response data reception process and the device data reception process are a process of receiving response data or a device data from the extension paper-feeder device 50 or the extension paper output device 80 via the connection line 6.

The common permission data transmission process is a process of outputting common permission data stored in the common permission data storage 204*a* to the connection line 5, thereby transmitting the common permission data to the extension paper-feeder device 50 and the extension paper output device 80. Note that the data output to the connection line 5 by the printer communication control circuit 208 is transmitted via the paper-feeder connector 4 to only the extension paper-feeder device 50 of the first stage connected to the printer 2, and via the paper output connector 3 to only the extension paper output device 80 of the first stage connected to the printer 2.

[Electric Structure of Extension Paper-Feeder Device]

Figure 4A:
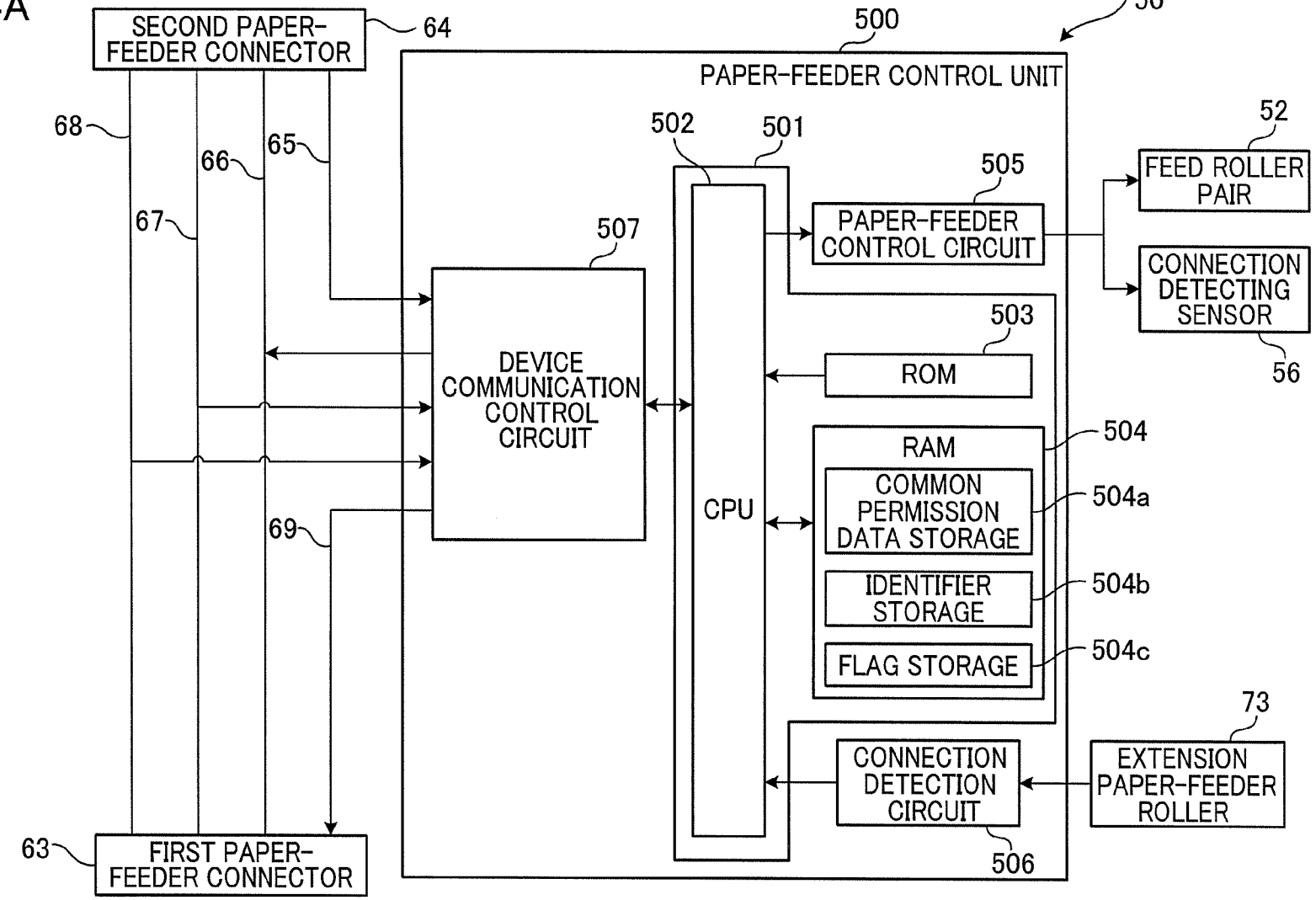
FIG. 4A is a diagram showing an electrical structure of an extension paper-feeder device shown in FIG. 1.

As shown in FIG. 4A, the extension paper-feeder device 50 is controlled its operation by the paper-feeder control unit 500. The paper-feeder control unit 500 is mainly structured by a micro computer 501 disposed on a circuit board, and additionally includes various circuits. The micro computer 501 includes a CPU 502 (device-side controller) which performs control based on a pre-set program; a ROM 503, and a RAM 504. The ROM 503 stores various programs to be run by the CPU 502.

The RAM 504 temporarily stores data, and includes a common permission data storage 504*a*, an identifier storage 504*b*, and a flag storage 504*c*. The common permission data storage 204*a* stores data identical to the paper-feeder common permission data stored in the common permission data storage 504*a* of the printer 2. The identifier storage 504*b* stores in advance a unique identifier for each of the extension paper-feeder devices 50. Further, the flag storage 504*c* stores a common permission data flag indicative of whether or not the paper-feeder common permission data has been received from the printer 2, and a forward flag indicative of whether or not the later-described forwarding process has been performed. The common permission data flag and the forward flag are both initially in the off-state.

Further, the CPU 502 is connected to and controls a paper-feeder control circuit 505, a connection detection circuit 506, and a device communication control circuit 507 (device-side communication interface). Note that the control of the paper-feeder control circuit 505 by the CPU 502 is performed based on the command data transmitted from the printer 2.

The paper-feeder control circuit 505 controls the extension paper-feeder roller 52 and the feed roller pair 56 so that the sheet P is fed from the extension paper-feeder device 50 to the printer 2. The connection detection circuit 506 receives detection signals from the connection detecting sensor 73.

The device communication control circuit 507 performs a device-side connection confirmation data reception process (hereinafter, connection confirmation data reception process), a command data reception process, a device-side response data transmission process (hereinafter, response data transmission process), a device data transmission process, a reset data reception process, a common permission data reception process, and a forwarding process. The connection confirmation data reception process and the command data reception process are a process of receiving the connection confirmation data or the command data transmitted from the printer 2 via the connection line 67. Further, the response data transmission process and the device data transmission process are a process of outputting the response data or the device data to the connection line 66, thereby transmitting the data to the printer 2. Further, the reset data reception process is a process of receiving the reset data from the printer 2, via the connection line 68.

The common permission data reception process is a process of receiving via the connection line 65 common permission data from the printer 2 adjacent thereto, or forwarded from the extension paper-feeder device 50 of the previous stage adjacent thereto. The forwarding process is a process of outputting the common permission data to the connection line 69, thereby forwarding the data to the extension paper-feeder device 50 of the subsequent stage. Note that the data output to the connection line 69 by the device communication control circuit 507 is transmitted only to the adjacent extension paper-feeder device 50 of the subsequent stage via the second paper-feeder connector 64. In other words, an extension paper-feeder device 50 of second or any of the subsequent stages connected to the printer 2 is not able to directly receive the common permission data from the printer 2. Such an extension paper-feeder device 50 receives the common permission data which is forwarded from the extension paper-feeder device 50 of the previous stage.

[Electric Structure of Extension Paper Output Device]

Figure 4B:
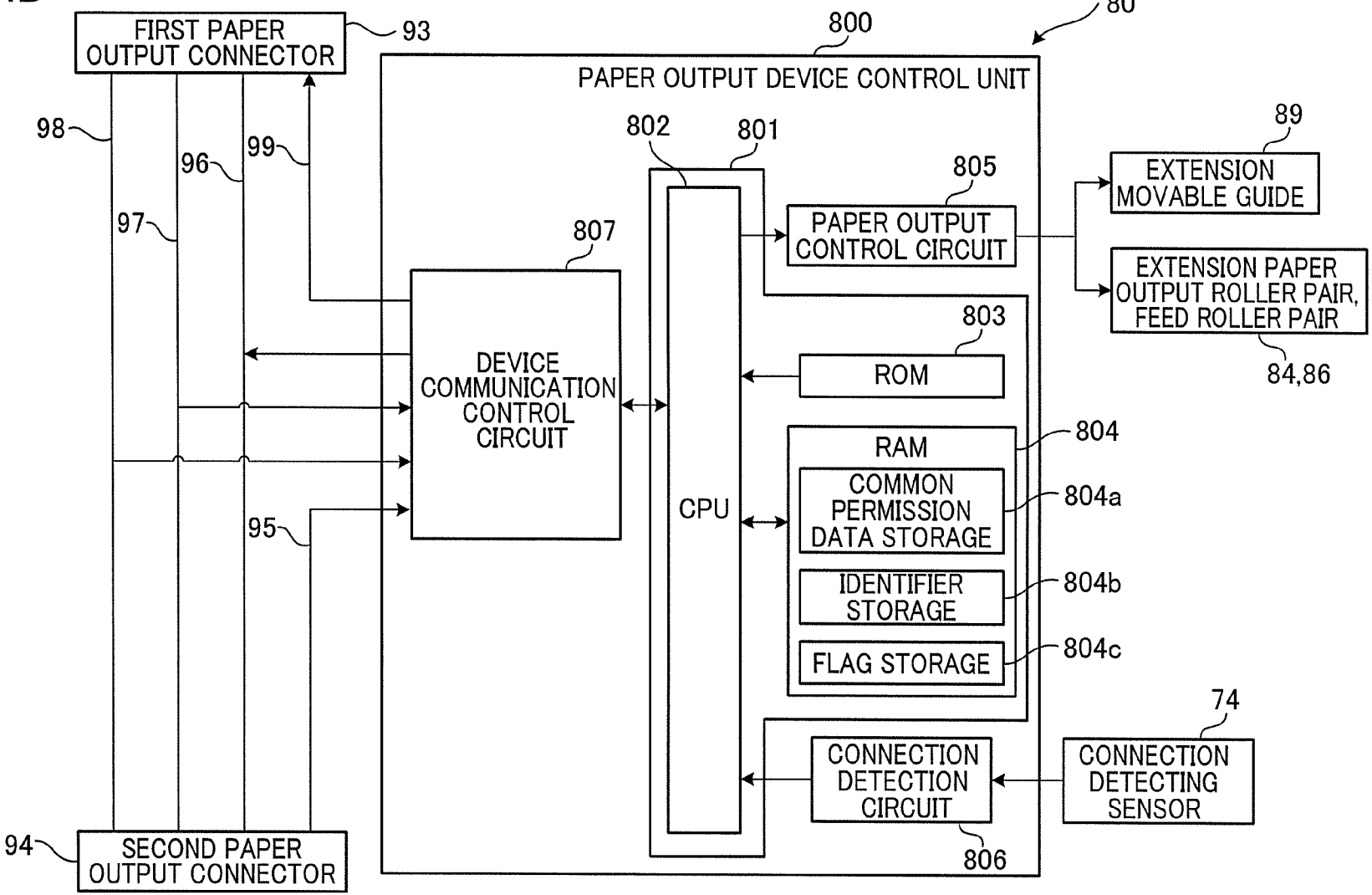
FIG. 4B is a diagram showing an electrical structure of an extension paper output device shown in FIG. 2.

As shown in FIG. 4B, the extension paper-feeder device 50 is controlled its operation by the paper output device control unit 800. The paper output device control unit 800 has substantially the same structure as that of the above-mentioned paper-feeder control unit 500, except in that the paper-feeder control circuit 505 is replaced with a paper output control circuit 605. Therefore, each part corresponding to the paper-feeder control unit 500 is given a reference numeral which is 300 plus the reference numeral of the part in the paper-feeder control unit 500. No further explanation for such a part is provided here. Note that the common permission data storage 804*a* of the RAM 804 stores data identical to the paper-output common permission data stored in the common permission data storage 504*a* of the printer 2. Further, the identifier storage 504*b* stores in advance a unique identifier for each of the extension paper output devices 80.

The paper output control circuit 605 controls the extension movable guide 89, the feed roller pair 84, and the extension paper output roller pair 86 so as to output to the extension paper output tray 87 a sheet P conveyed from the printer 2, or to convey a sheet P from the printer 2 to an extension paper output device 80 positioned above.

[Operation of Printer System]

Next, with reference to FIG. 5 to FIG. 7B, the following describes an operation of the printer system 1.

(Operation of Printer)

Figure 5:
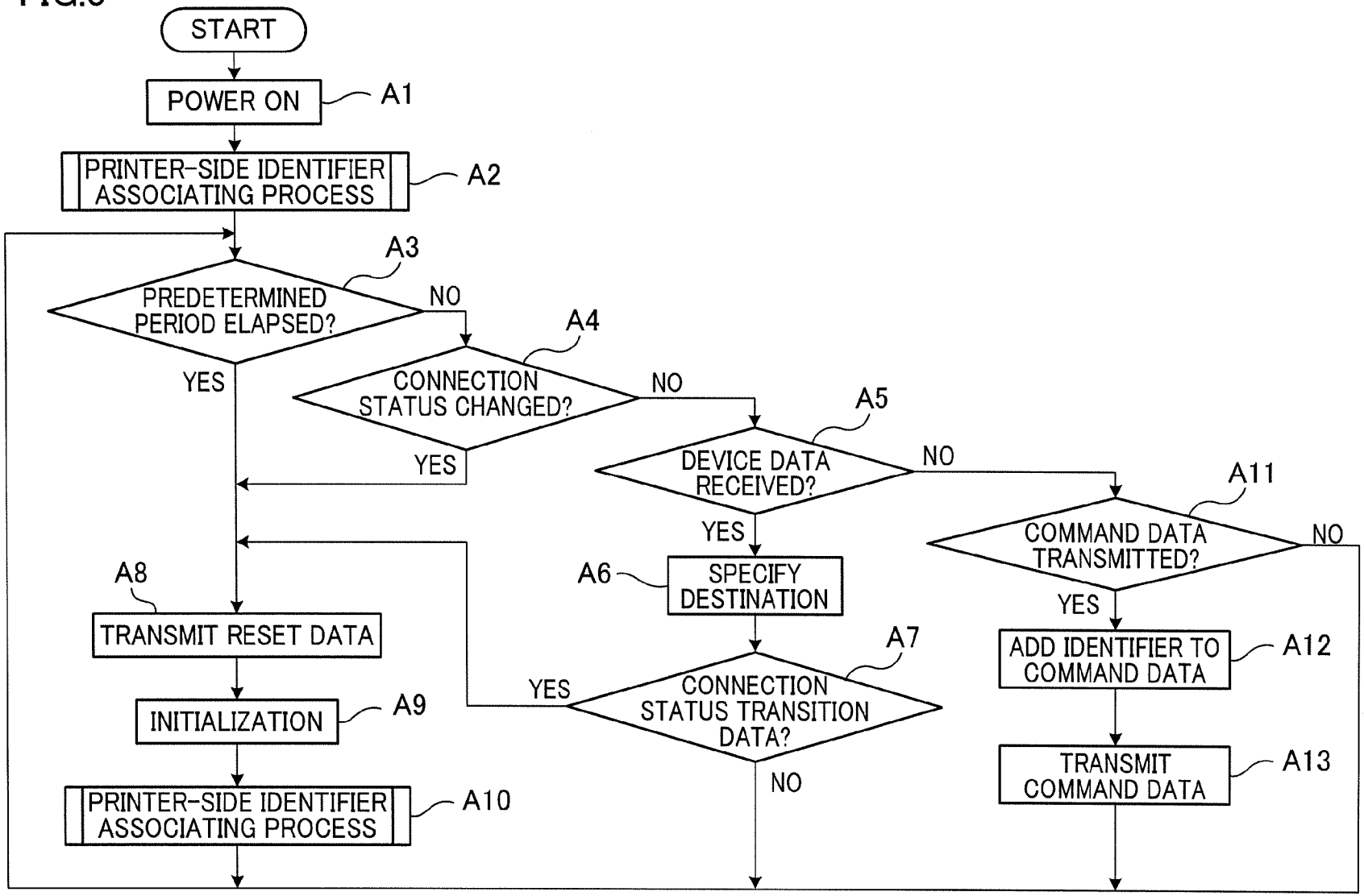
FIG. 5 is a flowchart explaining an operation of the printer shown in FIG. 1.

First, the operation of the printer 2 is described with reference to FIG. 5. When the printer system 1 is powered ON (A1), the CPU 202 first performs printer-side identifier associating process which is described later with reference to FIG. 7A (A2). Through this printer-side identifier associating process, the lower identifier storage 250 stores the identifier assigned to each of the extension paper-feeder devices 50 in association with the stage position information indicative of the position of the corresponding extension paper-feeder device 50 among the extension paper-feeder devices 50. Further, the upper identifier storage 251 stores the identifier assigned to each of the extension paper output devices 80, in association with the stage position information indicative of the position of the corresponding extension paper output device 80 among the extension paper output devices 80.

Next, the CPU 202 determines whether or not a predetermined period has elapsed since the immediately previous printer-side identifier associating process (A3). When it is determined that the predetermined period has elapsed (A3: YES), the process moves to A8. On the other hand, when it is determined that the predetermined period has not yet elapsed (A3: NO), the CPU 202 determines whether or not there is a change in the output status of the detection signals input from the connection detecting sensors 71 and 72 via the connection detection circuit 207 (A4). When it is determined that there is a change in the output status of the detection signals from the connection detecting sensors 71 and 72 (A4: YES), the process moves to A8.

On the other hand in A4, when it is determined that there is no change in the output status of the detection signals from the connection detecting sensors 71 and 72 (A4: NO), the CPU 202 determines whether or not the printer communication control circuit 208 has received device data from the extension paper-feeder device 50 or the extension paper output device 80 (A5). When it is determined that the device data is received (A5: YES), the CPU 202 refers to the lower identifier storage 250 and the upper identifier storage 251 to specify the extension paper-feeder device 50 or the extension paper output device 80 from which the device data is transmitted, based on the identifier contained in the device data (A6). Next, the CPU 202 determines whether or not the device data having been received is connection status transition data indicating a change in the output status of the detection signal from the connection detecting sensor 73 or the connection detecting sensor 74 (A7). When it is determined that the device data is the connection status transition data (A7: YES), the process moves to A8. On the other hand, when it is determined that the device data is the connection status transition data (A7: NO), the process returns to A3.

In A8, the CPU 202 controls the printer communication control circuit 208 so as to perform the reset data process. After that, the CPU 202 initializes the recorded contents of the common permission data storage 204*a*, the identifier storage 204*b*, the transmission count storage 204*c*, the transmission data storage 204*d* (A9), and then performs the printer-side identifier associating process which is described later with reference to FIG. 7A (A10). Through this, the identifier assigned to each of the extension paper-feeder devices 50 and the associated stage position information in the lower identifier storage 250, and the identifier assigned to each of the extension paper output devices 80 and the associated stage position information in the upper identifier storage 251 are all updated. As a result, the association of the identifier and the position information is kept updated and accurate. After A10, the process returns to A3.

On the other hand in A5, when it is determined that no device data has been received (A5: NO), the CPU 202 determines whether or not there is command data to be transmitted to a specific extension paper-feeder device 50 or to a specific extension paper output device 80 (A11). When it is determined that there is no command data (All: NO), the process returns to A3. On the other hand, when it is determined that there is command data (A11: YES), the CPU 202 refers to the lower identifier storage 250 or the upper identifier storage 251 to add, to the command data, the identifier assigned to that specific extension paper-feeder device 50 or the identifier assigned to that specific extension paper output device 80 (A12), and controls the printer communication control circuit 208 so as to perform the command transmission process related to the command data (A13). After A13, the process returns to A3. Thus, the operation of the printer 2 is described hereinabove.

[Operation of Extension Paper-Feeder Device]

Figure 6:
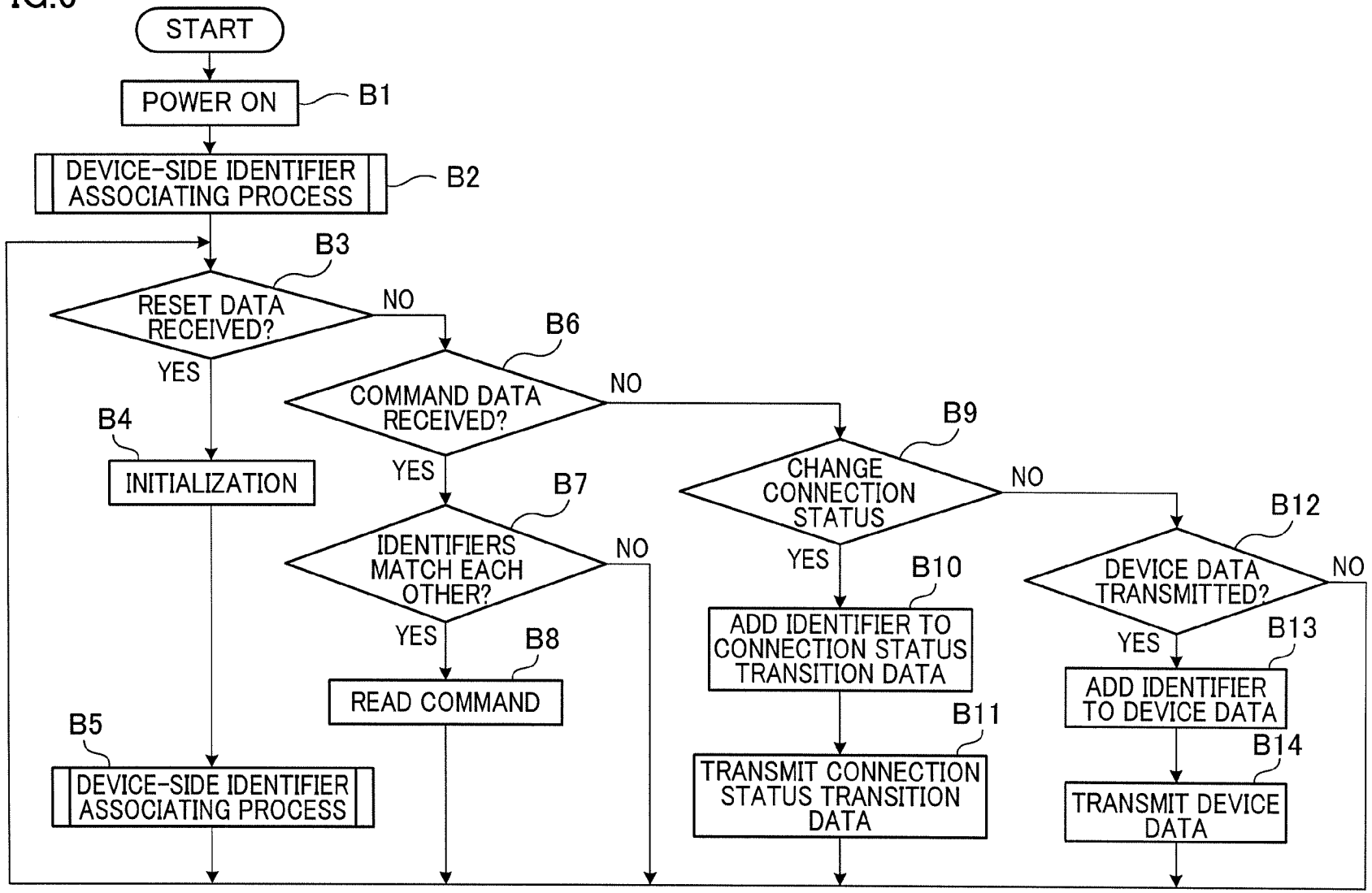
FIG. 6 is a flowchart explaining an operation of the extension paper-feeder device shown in FIG. 1.

Next, the following describes an operation of the extension paper-feeder device 50 with reference to FIG. 6. Note that the operation of the extension paper output device 80 is substantially the same as that of the extension paper-feeder device 50, therefore explanation of the operation of the extension paper output device 89 is omitted.

When the printer system 1 is powered ON (B1), the CPU 502 first performs device-side identifier associating process which is described later with reference to FIG. 7B (B2).

Next, the CPU 502 determines whether or not the device communication control circuit 507 has received the reset data (B3). When it is determined that the reset data has been received (B3: YES) the CPU 502 initializes the recorded contents of the flag storage 504*c* in the RAM 504 (B4). The CPU 502 then performs the device-side identifier associating process which is described later with reference to FIG. 7B (B5), and the process returns to B3.

On the other hand, when it is determined that no reset data has been received (B3: NO), the CPU 502 determines whether or not the device communication control circuit 507 has received the command data from the printer 2 (B6). When it is determined that the command data has been received (B6: YES), the CPU 502 determines whether or not the identifier contained in the command data matches with the unique identifier stored in the identifier storage 504*b* (B7). When it is determined that the identifiers match with each other (B7: YES), the CPU 502 reads the command data, and controls the paper-feeder control circuit 505 or the like based on the command data (B8). After B8, the process returns to B3. On the other hand, when it is determined that the identifiers do not match with each other (B7: NO), the process returns to B3 without reading the command data received.

In B6, when it is determined that no command data has been received (B6: NO), the CPU 502 determines whether there is a change in the output status of the detection signal from the connection detecting sensor 73, which signal is input via the connection detection circuit 506 (B9). When it is determined that the output status of the detection signal of the connection detecting sensor 73 has changed (B9: YES), the CPU 502 adds the unique identifier stored in the identifier storage 504*b* to the connection status transition data which is the device data (B10), and controls the device communication control circuit 507 so as to perform the device data transmission process related to the connection status transition data (B11). Then, the process returns to B3.

On the other hand, when it is determined in B9 that there is no change in the output status of the detection signal of the connection detecting sensor 73 (B9: NO), the CPU 502 determines whether or not there is device data other than the connection status transition data to be transmitted to the printer 2 (B12). When it is determined that there is device data (B12: YES), the CPU 502 adds the unique identifier stored in the identifier storage 504*b* to the device data (B13), and controls the device communication control circuit 507 so that the device data transmission process relative to the device data is performed (B 14). Then, the process returns to B3. Further, when it is determined in B12 that there is no device data (B12: NO), the process returns to B3. Thus, the operation of the extension paper-feeder device 50 is described hereinabove.

(Printer-Side Identifier Associating Process)

Figure 7A:
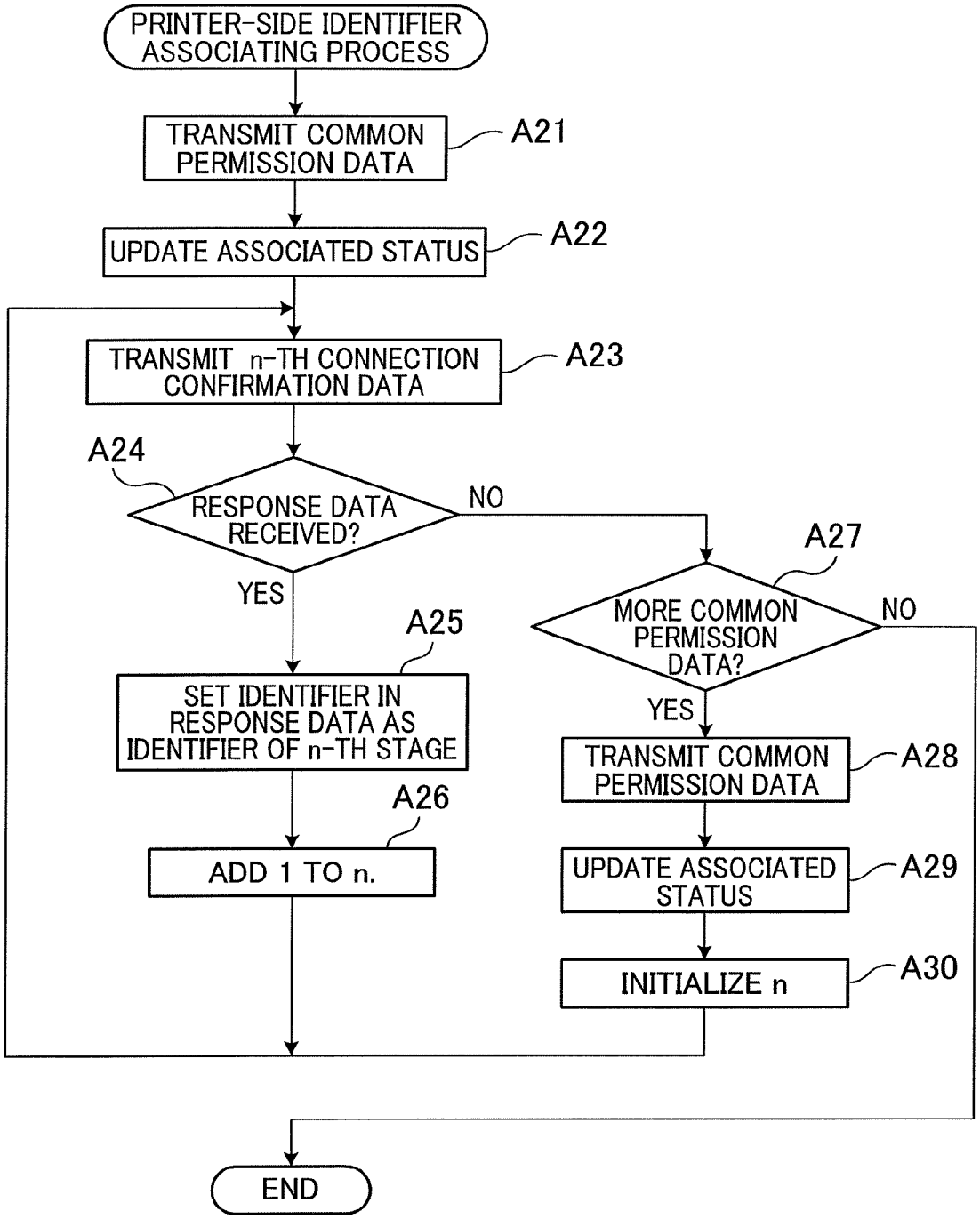
FIG. 7A is a flowchart of the apparatus-end identifier assigning process of FIG. 5.

Next, the following describes the printer-side identifier associating process, with reference to FIG. 7A. The CPU 202 first controls the printer communication control circuit 208 so that a set of common permission data among a plurality of sets of common permission data stored in the common permission data storage 204*a* is transmitted (A21). Then, the common permission data transmitted is stored in the transmission data storage 204*d*, and the associated status related to the common permission data stored in the common permission data storage 204*a* is changed from "Not Transmitted" to "Transmitted"(A22). For the sake of convenience, it is assumed, in the following description, that the CPU 202 controls the printer communication control circuit 208 so as to transmit the paper-feeder common permission data in A21.

After A22, the CPU 202 controls the printer communication control circuit 208 so as to perform the connection confirmation data transmission process in relation to connection confirmation data transmitted for the first time (A23). Note that in the connection confirmation data transmission process, the first connection confirmation data transmitted is data for confirming whether or not an extension paper-feeder device 50 of the first stage is connected to the printer 2. Similarly, the n-th (where n is a natural number) connection confirmation data transmitted in the connection confirmation data transmission process is data for confirming whether or not an extension paper-feeder device 50 of the n-th stage is connected to the printer 2.

After A23, the CPU 202 determines whether or not the printer communication control circuit 208 has received the response data corresponding to the connection confirmation data transmission process (A24). Specifically, it is supposed that the response required period is a sum of time taken from the point where the printer 2 transmits the connection confirmation data in the connection confirmation data transmission process to the points where the extension paper-feeder device 50 for which connection is to be confirmed receives the connection confirmation data; time taken by the extension paper-feeder device 50 having received the connection confirmation data for transmitting the response data corresponding to the connection confirmation data transmission process; and time taken between a point where the extension paper-feeder device 50 transmits the response data to a point where the printer 2 receives the response data. If the printer 2 receives no response data after elapse of the response required period from transmission of the connection confirmation data in the connection confirmation data transmission process, the CPU 202 determines that the printer communication control circuit 208 received no response data.

When it is determined in A24 that the response data is received (A24: YES), the CPU 202 stores in the identifier storage 204*b* the value of transmission count n stored in the transmission count storage 204*c* as the value indicative of the position of the extension paper-feeder device 50 corresponding to the identifier contained in the response data (A25). More specifically, the CPU 202 determines which one of the paper-feeder common permission data and the paper-output common permission data is stored in the transmission data storage 204*d*. When it is determined that the paper-feeder common permission data is stored in the transmission data storage 204*d*, the identifier contained in the response data is stored in the lower identifier storage 250 as the identifier of the extension paper-feeder device 50 of the n-th stage connected to the printer 2. On the other hand, when it is determined that the paper-output common permission data is stored in the transmission data storage 204*d*, the identifier contained in the response data is stored in the upper identifier storage 251 as the identifier of the extension paper output device 80 of the n-th stage connected to the printer 2. Thus, for example, when the paper-feeder common permission data is stored in the transmission data storage 204*d*, the identifier contained in the response data corresponding to the first connection confirmation data transmission process is stored in the lower identifier storage 250 as the identifier of the extension paper-feeder device 50 of the first stage connected to the printer 2.

After A25, the CPU 202 adds 1 to the transmission count n stored in the transmission count storage 204*c* (A26). Then, the process returns to A23. Hereinafter, the CPU 202 repeats the A23 to A26 until the CPU 202 determines no response data corresponding to the connection confirmation data transmission process is received. Then, when it is determined that no response data corresponding to the connection confirmation data transmission process is received in A24 (A24: NO), the CPU 202 determines that the number of extension paper-feeder devices 50 serially connected to the printer 2 in multiple stages is the number resulting from subtracting 1 from the transmission count n performed by the printer 2 in the connection confirmation data transmission process. Namely, when the response data corresponding to the n-th connection confirmation data transmission process is not received, the CPU 202 determines that the number of extension paper-feeder devices 50 serially connected to the printer 2 is n−1. After that, the process moves to S27.

In the process of S27, the CPU 202 determines whether or not the sets of common permission data in the common permission data storage 204*a* include common permission data whose associated status is "Not Transmitted". When it is determined that the sets of common permission data include one or more sets of common permission data whose associated status is "Not Transmitted" (A27: YES), the CPU 202 controls the printer communication control circuit 208 so as to transmit one of the one or more sets of "Not Transmitted" common permission data (A28). That is, the paper-output common permission data is output as the common permission data transmission process. After that, the common permission data having been transmitted is stored in the transmission data storage 204*d*, and the associated status of that common permission data, stored in the common permission data storage 204*a* is changed from the "Not Transmitted" to "Transmitted" (A29). Next, the transmission count n stored in the transmission count storage 204*c* is initialized to "1" (A30), and the process returns to A23. Then, the CPU 202 repeats A23 to A26 until the CPU 202 determines in A24 that no response data for the connection confirmation data transmission process is received.

In A27, when it is determined that there is no common permission data whose associated status is "Not Transmitted" (A27: NO), the process is ended.

(Device-Side Identifier Associating Process)

Figure 7B:
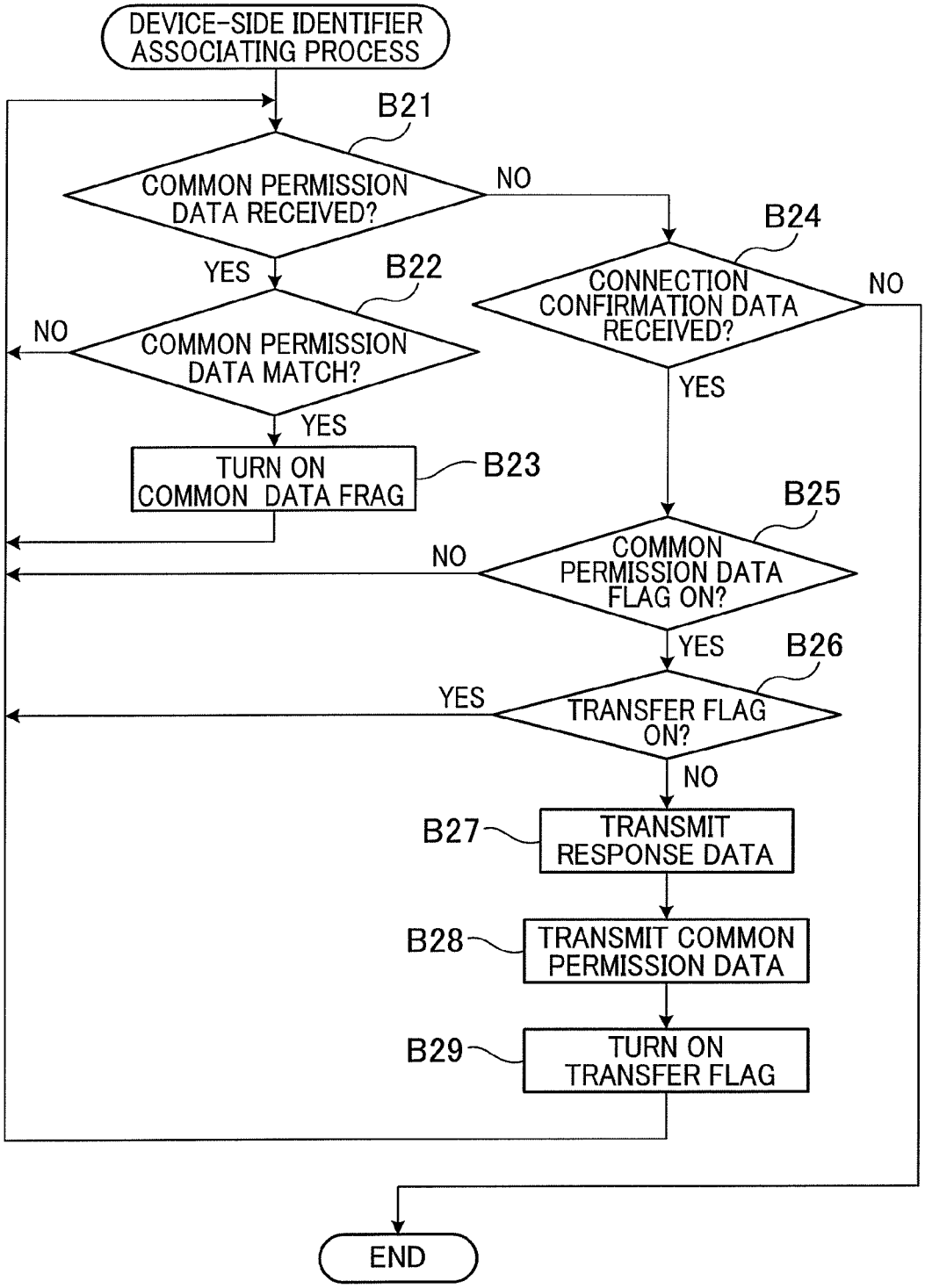
FIG. 7B is a flowchart of the device-end identifier assigning process of FIG. 6.

Next, the following describes the device-side identifier associating process with reference to FIG. 7B. First, the CPU 502 determines whether or not the device communication control circuit 507 has received common permission data (B21). When it is determined that the common permission data is received (B21: YES), the CPU 502 determines whether or not the common permission data matches with the common permission data stored in the common permission data storage 504*a* (B22). When it is determined that the sets of common permission data do not match with each other (B22: NO), the process returns to B21. On the other hand, when it is determined that the sets of common permission data match with each other (B22: YES), the CPU 502 turns on the common permission data flag stored in the flag storage 504*c* (B23). Then, the process returns to B21.

On the other hand, when it is determined in B21 that no common permission data is received (B21: NO), the CPU 502 determines whether or not the device communication control circuit 507 has received the connection confirmation data within a predetermined period (B24). When it is determined that the connection confirmation data is received within the predetermined period (B24: YES), the CPU 502 determines whether or not the common permission data flag stored in the flag storage 504*c* is in the on-state (B25). When it is determined that the common permission data flag is not in the on-state (B25: NO), the process returns to B21. On the other hand, when it is determined that the common permission data flag is in the on-state (B25: YES), the CPU 502 determines that the forward flag stored in the flag storage 504*c* is in the on-state (B26). When it is determined that the forward flag is in the on-state (B26: YES), the process returns to B21.

On the other hand, when it is determined that the forward flag is not in the on-state (B26: YES), the CPU 502 adds unique identifier stored in the identifier storage 504*b* to the response data, and controls the device communication control circuit 507 so as to perform the device-side response data transmission process related to the response data (B27). After that, the CPU 502 controls the device communication control circuit 507 so as to perform forwarding process of forwarding the common permission data received by the device communication control circuit 507 to an extension paper-feeder device 50 of the subsequent stage (B28). Then, the CPU 502 turns on the forward flag stored in the flag storage 504*c* (B29). Thus, when the connection confirmation data is received by the device communication control circuit 507 after the response data transmission process, it is possible to prevent transmission of the response data for the connection confirmation data to the printer 2. After B29, the process returns to B21.

On the other hand, when it is determined in B24 no connection confirmation data is received within the predetermined period (B24: NO), the process is ended.

As described above, with the printer system 1 of the present embodiment, the identifiers assigned to the extension paper-feeder devices 50 and the extension paper output devices 80 are associated with the respective positions of these devices in the multiple stages, after the extension paper-feeder devices 50 and the extension paper output devices 80 are serially connected to the printer 2. Further, for the connection confirmation data transmitted from the printer 2, the response data is transmitted to the printer 2 from the extension paper-feeder devices 50 and the extension paper output devices 80, sequentially in the order of their positions in the multiple stages. Therefore, the identifier of each device is easily associated with its position in the multiple stages. This way, there is no need for determining in advance the respective positions of the extension paper-feeder devices 50 and the extension paper output devices 80 to be serially connected. The freedom of arranging these devices is therefore improved.

Further, in the printer system 1 of the present embodiment after printer-side identifier associating process in the printer 2, and after the device-side identifier associating process in the extension paper-feeder devices 50 and in the extension paper output devices 80, it is possible to unmistakably specify any one of the extension paper-feeder devices 50 or any one of the extension paper output devices 80, by including the identifier in the command data and the device data. This enables data communication in a selectable manner between the printer and a specific one of connectable devices.

Further, the present embodiment deals with a case where a connectable device group including extension paper-feeder devices 50 and a connectable device group including the extension paper output devices 80 are connected to the printer of the printer system 1. It is however possible to associate the identifier of the device with the position of the same, for all of the connectable devices. Since the printer of the present embodiment requires no connection lines for transmitting the common permission data to each connectable device group, the number of lines is reduced.

<Second Embodiment>

The following describes a second embodiment. The differences of the second embodiment from the first embodiment are as follows. Namely, in the first embodiment, the identifier storage 504*b* of the paper-feeder control unit 500 and the identifier storage 804*b* of the paper output device control unit 800 store in advance unique identifiers. However, in the second embodiment, these identifier storages initially store no identifiers, and are structured to store identifier contained in the connection confirmation data from the printer 2. Further, in the first embodiment, a connectable device of the second or any of subsequent stages connected to the printer 2 is able to directly receive the connection confirmation data from the printer 2 via the connection line in the connectable device of the previous stage. However, the second embodiment deals with a case where the connection confirmation data is not directly receivable from the printer 2. In the second embodiment, the connection confirmation data is received by the forwarding process performed by the connectable device of the previous stage. Further, in the second embodiment, the RAM 204 does not include the common permission data storage 204*a*, the transmission data storage 204*d*, and the RAM 504 and the RAM 804 do not include the common permission data storages 504*a* and 804*a*. That is, in the second embodiment, the printer communication control circuit 208 does not perform the common data transmission process, and the device communication control circuits 507 and 807 do not perform the common data reception process. In the description below, the parts that are identical to those of the above-mentioned first embodiment are given the same reference numerals, and explanation for them is omitted.

Figure 8:
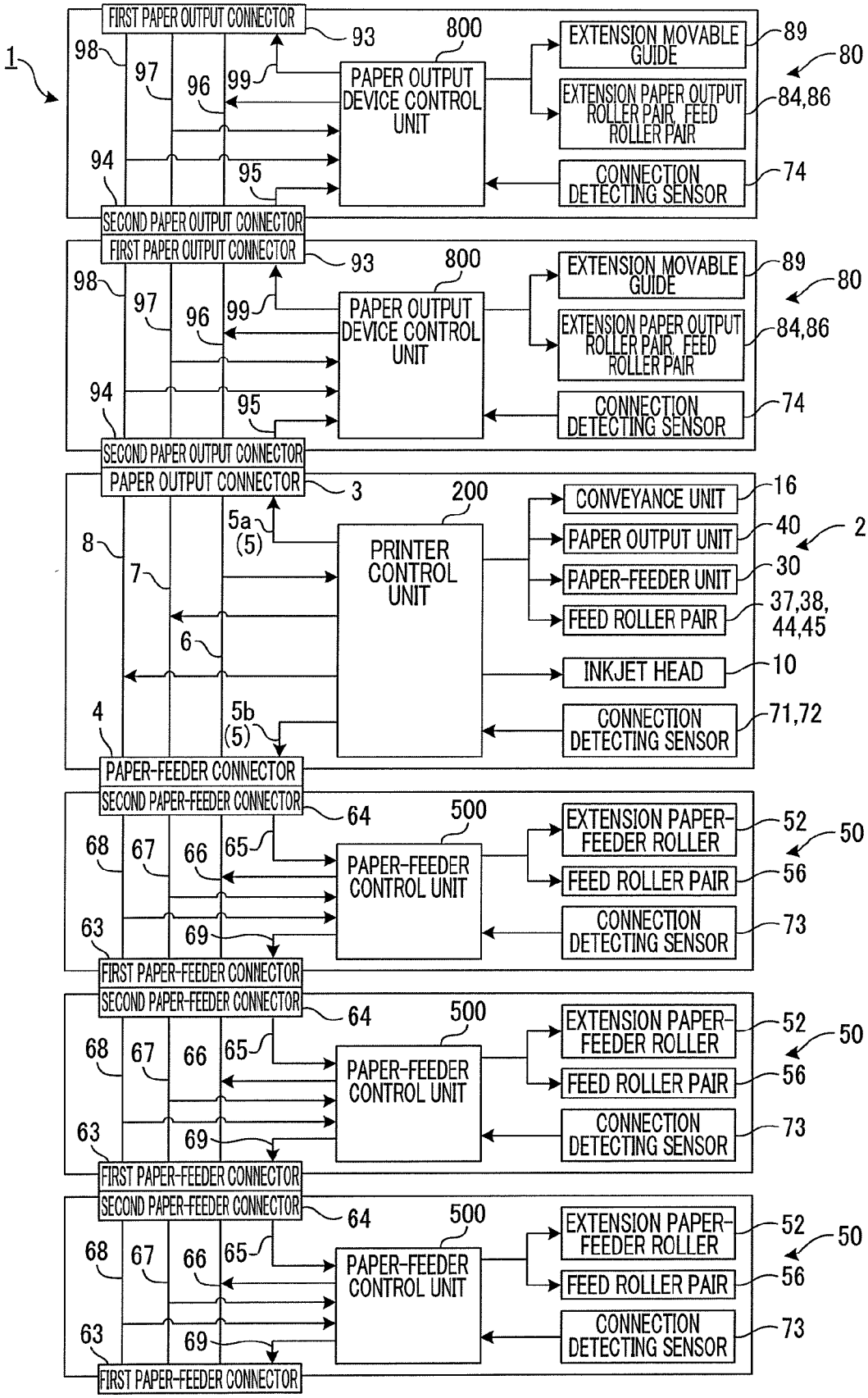
FIG. 8 is a diagram showing an electrical structure of a printer system of a second embodiment.

As shown in FIG. 8, in the present embodiment, the connection line 5 is not a signal line for connecting the printer control unit 200, the paper output connector 3, and the paper-feeder connector 4. The connection lines 5 include: an upper connection line 5*a* connecting the printer control unit 200 and the paper output connector 3; and a lower connection line 5*b* connecting the printer control unit 200 and the paper-feeder connector 4.

Further, in the identifier storage 204*b* of the RAM 204 is stored an identifier for each position of the multiple stages. Specifically, the lower identifier storage 250 stores therein positions of the multiple stages and, for each of the positions, a corresponding identifier for the connectable device (extension paper-feeder device 50) to be connected to the printer 2 via the paper-feeder connector 4. Further, the upper identifier storage 251 stores therein the positions of the multiple stages and, for each of the positions, a corresponding identifier for the connectable device (extension paper output device 80) to be connected to the printer 2 via the paper output connector 3.

Further, the identifier storage 204*b* stores: output destination status information indicative of to which one of the connection lines 5*a* and 5*b* the connection confirmation data is to be output in the next printer-side identifier associating process, the connection lines 5*a* and 5*b* being lines for transmitting the connection confirmation data to the connectable device; already-output connection line information indicative of the connection line to which the connection confirmation data has already been output in the past; and connectable device presence information indicative of the presence of the connectable device corresponding to the identifier stored in the lower identifier storage 250 and the upper identifier storage 251.

The connection confirmation data transmission process performed by the printer communication control circuit 208 of the printer 2 is as follows. Namely, when transmitting the connection confirmation data to the extension paper-feeder device 50, the connection confirmation data is transmitted to the extension paper-feeder device 50 by outputting the data to the lower connection line 5*b*. This way the connection confirmation data output by the printer communication control circuit 208 to the lower connection line 5*b* is transmitted via the paper-feeder connector 4 only to the extension paper-feeder device 50 of the first stage connected to the printer 2. On the other hand, when transmitting the connection confirmation data to an extension paper output device 80, the connection confirmation data is transmitted to the extension paper output device 80 by outputting the data to the upper connection line 5*a*. This way the connection confirmation data output by the printer communication control circuit 208 to the upper connection line 5*a* is transmitted via the paper output connector 3 only to the extension paper output device 80 of the first stage connected to the printer 2.

Further, the connection confirmation data reception process performed by the device communication control circuits 507 and 807 of the extension paper-feeder device 50 or the extension paper-output device 80 is a process of receiving the connection confirmation data forwarded from the printer 2 adjacent thereto, or the extension paper-feeder device 50 of the previous stage, via the connection lines 65, 95. Further, the forwarding process is a process of outputting the connection confirmation data to the connection lines 69, 99 so as to forward the connection confirmation data to the extension paper-feeder device 50 or the extension paper output device 80 of the subsequent stage.

(Printer-Side Identifier Associating Process)

Figure 9A:
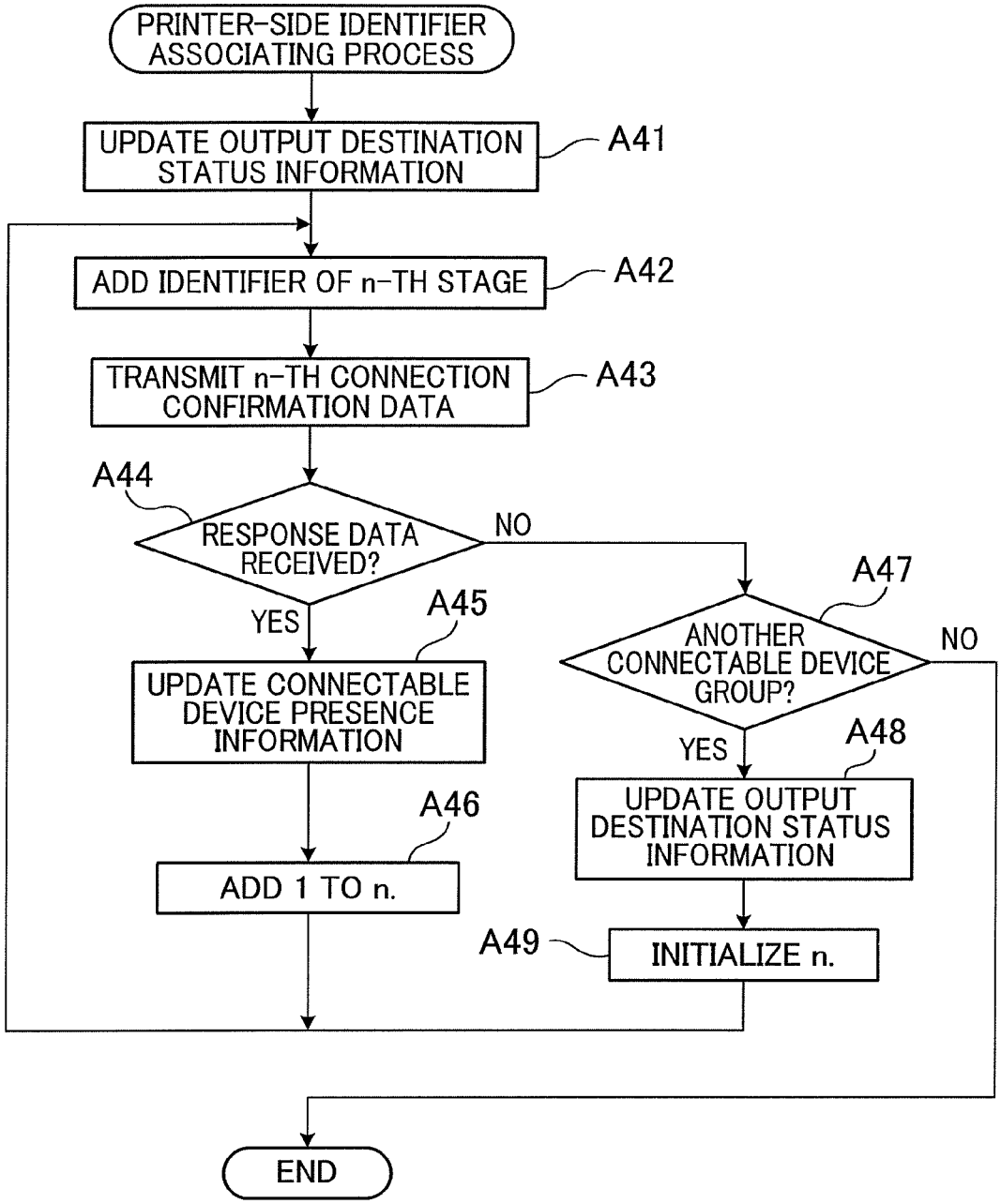
FIG. 9A is a flowchart of an apparatus-end identifier assigning process of the second embodiment.

Next, the following describes the printer-side identifier associating process of the printer 2, with reference to FIG. 9A. First, the CPU 202 stores one of "Upper Connection Line" and "Lower Connection Line" as the output destination status information in the identifier storage 204*b*, and adds that connection line stored to the already-output connection line information in the identifier storage 204*b* (A41). Next, based on the output destination status information stored in the identifier storage 204*b* and the transmission count n stored in the transmission count storage 204*c*, the CPU 202 adds to n-th connection confirmation data the identifier of the n-th stage stored in the identifier storage 204*b* (A42). More specifically, when the output destination status stored in the identifier storage 204*b* is "Upper Connection Line", the identifier corresponding to the n-th stage stored in the upper identifier storage 251 corresponding to the upper connection line 5*a* is added to the n-th connection confirmation data. On the other hand, when the output destination status stored in the identifier storage 204*b* is "Lower Connection Line", the identifier corresponding to the n-th stage stored in the lower identifier storage 250 corresponding to the lower connection line 5*b* is added to the n-th connection confirmation data.

After A42, the CPU 202 controls the printer communication control circuit 208 so that the n-th connection confirmation data transmission process is performed (A43). Next, the CPU 202 determines whether or not the printer communication control circuit 208 has received the response data for the connection confirmation data transmission process (A44). When it is determined that the response data has been received (A44: YES), the CPU 202 determines that there is a connectable device corresponding to the identifier transmitted in the n-th connection confirmation data transmission process, and updates the connectable device presence information in the identifier storage 204*b* (A45). Then, the CPU 202 adds 1 to the transmission count n stored in the transmission count storage 204*c* (A46). Then, the process returns to A42. After that, the CPU 202 repeats the A42 to A46 until the CPU 202 determines in A44 that no response data is received for the connection confirmation data transmission process.

In A44, when the CPU 202 determines that no response data is received for the connection confirmation data transmission process (A44: NO), the CPU 202 determines whether or not the already-output connection line information in the identifier storage 204*b* misses either one of the connection lines 5*a* and 5*b* for transmitting the connection confirmation data to the connectable device (A47). When it is determined that the already-output connection line information misses one of the connection lines (A47: YES), the CPU 202 adds, to the output destination status information in the identifier storage 204*b*, that connection line missing in the already-output connection line information and adds the same connection line to the already-output connection line information in the identifier storage 204*b* (A48). Next, the transmission count stored in the transmission count storage 204*c* is initialized to "1" (A49), and the process returns to A42. After that, the CPU 202 repeats A42 to A46 until the CPU 202 determines in A44 that no response data is received for the connection confirmation data transmission process.

On the other hand, when the CPU 202 determines in A47 that the already-output connection line information in the identifier storage 204*b* contains the both of the connection lines 5*a* and 5*b* (A47: NO), the process is ended.

(Device-Side Identifier Associating Process)

Figure 9B:
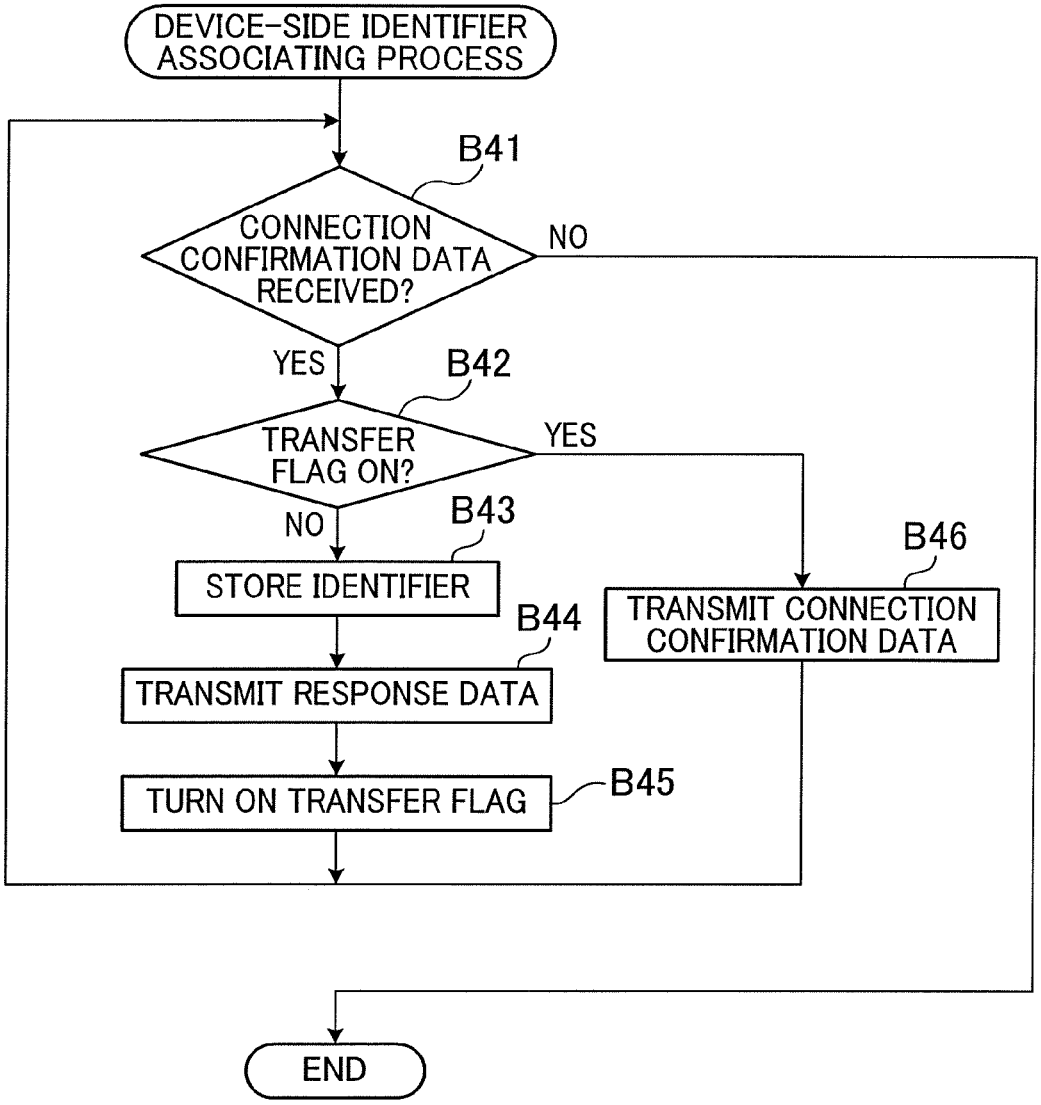
FIG. 9B is a flowchart of a device-end identifier assigning process of the second embodiment.

Next, the following describes the device-side identifier associating process of the extension paper-feeder device 50 with reference to FIG. 9B. Note that the device-side identifier associating process of the extension paper output device 80 is not described as it is substantially the same as the device-side identifier associating process of the extension paper-feeder device 50.

First, the CPU 502 determines whether or not the device communication control circuit 507 has received connection confirmation data within a predetermined period (B41). When it is determined that the connection confirmation data is received (B41: YES), the CPU 502 determines whether or not the forward flag stored in the flag storage 504*c* is in the on-state (B42). When it is determined that the forward flag is not in the on-state (B42: NO), the CPU 502 stores in the identifier storage 504*b* the identifier contained in the connection confirmation data (B43), and controls the device communication control circuit 507 so as to perform the response data transmission process (B44). Next, the CPU 502 turns the forward flag stored in the flag storage 504*c* to the on-state (B45). Then, the process returns to B41.

On the other hand, when it is determined in B42 that the forward flag is in the on-state (B42), the CPU 502 controls the device communication control circuit 507 so as to perform the forwarding process of forwarding the connection confirmation data received to the subsequent extension paper-feeder device 50 (B46). Then, the process returns to B41. This way, even when the connection confirmation data is received by the device communication control circuit 507 after the response data transmission process, the connection confirmation data is forwarded to the subsequent extension paper-feeder device 50, without transmitting the response data for the connection confirmation data to the printer 2.

Meanwhile, when the CPU 502 determines in B41 that the connection confirmation data is not received within the predetermined period (B41: NO), the process is ended.

With the printer system 1 of the present embodiment, the identifier assigned to an extension paper-feeder device 50 or an extension paper output device 80 is associated with the position of the device in the multiple stages of connected devices, after the extension paper-feeder device 50 or the extension paper output device 80 is connected to the printer 2. For connection confirmation data transmitted from the printer 2, the response data is transmitted from the extension paper-feeder devices 50 or the extension paper output devices 80 to the printer 2 sequentially in the order of the positions. Therefore, the identifier is easily associated with the position of the device. Therefore, there is no need to determine the positions of the extension paper-feeder devices 50 and those of the extension paper output devices 80 in the multiple stages. This improves the freedom of arranging the connectable devices.

In the first and second embodiments, data communications between the printer system 1 and the extension paper-feeder device 50 and the extension paper output device 80 is performed via connection lines 5 to 8. However, in the first embodiment, communication of data other than the common permission data may be performed wirelessly. In the second embodiment, communication of data other than the connection confirmation data may be performed wirelessly.

Further, in the above first embodiment, the process of associating the identifier performed in the printer system 1 may be changed to the process of associating the identifier of the second embodiment. That is, the structure may be adapted so that no identifier is stored in advance in the identifier storage 504 of the paper-feeder control unit 500 or in the identifier storage 804*b* of the paper output device control unit 800, and that the identifier contained in the connection confirmation data from the printer 2 is stored. In such a case, the identifier storage 204*b* of the printer 2 stores identifier for each position of the multiple stages. Then, the printer 2 adds, to the n-th connection confirmation data to be transmitted, the identifier corresponding to the n-th stage stored in the identifier storage 204*b*.

Further, in the second embodiment, the process of associating the identifier performed in the printer system 1 may be changed to the process of associating the identifier in the first embodiment. That is, the identifier storage 504*b* of the paper-feeder control unit 500 and the identifier storage 804*b* of the paper output device control unit 800 store therein unique identifiers, and this unique identifier is added to the response data to be transmitted to the printer 2. In such a case, the printer 2 stores in the identifier storage 204*b* the identifier contained in the response data for the n-th printer-side connection confirmation data transmission process, as the identifier of the connectable device in the n-th stage out of the multiple stages.

Further, the above first embodiment deals with a case where the extension paper-feeder devices 50 and the extension paper output devices 80 are able to receive all the connection confirmation data transmitted in the connection confirmation data transmission process performed by the printer communication control circuit 208 of the printer 2. However, the embodiment may be adapted so that the connection confirmation data is received only by a connectable device whose common permission data flag stored in the flag storage 504*c* is in the on-state and the forward flag stored in the flag storage 504*c* is in the off-state.

Further, the above embodiments deal with a case where the connectable devices are the extension paper-feeder device 50 and the extension paper output device 80. However, the connectable devices are not limited to those, and may be any connectable devices that can be serially connected to the printer 2. Further, the printer 2 may omit the printer paper-feeder tray 31 and the printer paper output tray 47.

Further, the above embodiments deal with a case where, when there is a change in the output status of the detection signal from any one of the connection detecting sensors 71 to 74, association of the stage position information with the identifiers of all the extension paper-feeder devices 50 and the extension paper output devices 80 serially connected to the printer 2 are updated. However, the present invention is not limited to this. For example, it is possible to adapt the embodiment so that, when there is a change in the output status of the detection signal from the connection detecting sensors 71 and 73 which detect the connection status of the extension paper-feeder devices 50, the identifiers of the extension paper-feeder devices 50 and the associated stage position information are updated, while the identifier of the extension paper output device 80 and the associated stage position information are not updated. It is further possible to adapt the embodiments so that, when the output status of the detection signal from the connection detecting sensor 73 provided in the extension paper-feeder device 50 is changed, the association of the stage position information is not updated for the identifier of the extension paper-feeder device 50 having that connection detecting sensor 73 whose output status has changed and the identifier of the extension paper-feeder device 50 of the previous stage, and is updated only for the extension paper-feeder device 50 of the subsequent stage. It is further possible to adapt the embodiments so that the connection detecting sensors 71 to 74 are omitted, and the identifier of the connectable device and the associated stage position information are updated every predetermined period or before transmission of the command data.

Further, in the above embodiments, the number of connectable device groups serially connected to the printer 2 is two: i.e., a connectable device group including a plurality of extension paper-feeder devices 50, and a connectable device group including a plurality of extension paper output devices 80. However, the number of groups is not limited to this. For example, the number of connectable device groups serially connected to the printer 2 may be one, or three or more.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

In the above-described embodiments, the micro computer 201, the micro computer 501 and the paper output device control unit 800 may be constituted by a single CPU. Alternatively, the micro computer 201, the micro computer 501 and the paper output device control unit 800 may be constituted by a plurality of CPUs, an application-specific integrated circuit (ASIC), or a combination of the CPU(s) and the ASIC.

What is claimed is:

1. A printer system, comprising a printer and a plurality of connectable devices, the printer comprising:

a printer-side connector configured to connect any of the connectable devices;

a printer-side communication interface configured to communicate with the connectable devices;

a printer-side identifier storage memory configured to store an identifier for each of the connectable devices and stage position information associated with the identifier, the stage position information being indicative of a position of one of the connectable devices with the corresponding identifier, in the plurality of connectable devices serially connected; and a printer-side controller, the connectable devices being serially connected to the printer in multiple stages, each of the connectable devices having a common function and comprising:

a device-side first connector configured to connect another one of the connectable devices;

a device-side second connector configured to connect one of the printer-side connector and the device-side first connector of another connectable device;

the device-side identifier storage memory configured to store the identifier;

a device-side communication interface configured to communicate with the printer or another connectable device; and a device-side controller, the printer-side controller being configured so as to perform, as an identifier associating process, a process such that the printer-side communication interface is controlled so as to repeat a printer-side connection confirmation data transmission process while a printer-side reception process is performed, the printer-side connection confirmation data transmission process being a process of transmitting, to the connectable devices via the printer-side connector, connection confirmation data for confirming a connection status with each of the connectable devices, the printer-side reception process being a process of receiving, via the printer-side connector, response data transmitted from the connectable devices in response to the printer-side connection confirmation data transmission process, the device-side controller being configured so as to perform, as the identifier associating process, a process such that the device-side communication interface is controlled so as to perform, after a device-side transmission process, a forwarding process of forwarding, to another connectable device via the device-side first connector, the connection confirmation data received through the device-side connection confirmation data reception process of receiving the connection confirmation data from the printer via the device-side second connector, the device-side transmission process being a process of transmitting the response data to the printer in response to the connection confirmation data;

the printer-side controller and the device-side controller further being configured so as to perform, as the identifier associating process, a process such that when the printer-side controller confirms connection with any one of the connectable devices through the printer-side reception process, the printer-side controller stores in the printer-side identifier storage memory the identifier and the position of that connectable devices for which connection has been confirmed, or the device-side controller of the connectable device for which connection has been confirmed stores in its device-side identifier storage memory the identifier corresponding to the position of that connectable device, which is stored in the printer-side identifier storage memory of the printer.

2. The printer system according to claim 1, wherein the device-side identifier storage memory of each connectable device stores in advance a unique identifier of the connectable device;

at a time of causing the device-side communication interface to perform the device-side transmission process, the device-side controller of each connectable device adds the identifier stored in the device-side identifier storage memory to the response data to be transmitted to the printer through the device-side transmission process; and when the response data transmitted from the connectable device is received in response to an n-th (where n is a natural number) printer-side connection confirmation data transmission process, in the printer-side reception process of the printer-side communication interface, the printer-side controller of the printer stores the identifier contained in the response data in the printer-side identifier storage memory as the identifier of the connectable device of an n-th stage in the multiple stages.

3. The printer system according to claim 1, wherein the printer-side identifier storage memory of the printer stores in advance the identifier corresponding to the position of the multiple stage;

when the printer-side communication interface performs an n-th (where n is a natural number) printer-side connection confirmation data transmission process, the printer-side controller of the printer adds to the connection confirmation data the identifier corresponding to the n-th stage stored in the printer-side identifier storage memory;

when the device-side communication interface performs the device-side transmission process in response to the device-side connection confirmation data reception process, the device-side controller of the connectable device stores in the device-side identifier storage memory the identifier contained in the connection confirmation data received through the device-side connection confirmation data reception process.

4. The printer system according to claim 1, wherein in data communication between the printer and any one of the connectable devices at a specific stage out of the multiple stages, after the identifier associating process is ended in the printer-side controller and the device-side controller, the printer-side controller of the printer, when transmitting data to that connectable device of the specific stage, refers to the printer-side identifier storage memory to add the identifier corresponding to the specific stage to the data to be transmitted, and transmits the data to all the connectable devices, and when receiving data from the connectable device, refers to the printer-side identifier storage memory and specify the connectable device from which the data is transmitted based on the identifier contained in the data, the device-side controller of the connectable device, when receiving data from the printer, reads the data only when the identifier contained in the data matches with the identifier stored in the device-side identifier storage memory, and when transmitting data to the printer, transmits data adding thereto the identifier stored in the device-side identifier storage memory.

5. The printer system according to claim 1, wherein when a predetermined period elapses after the identifier associating process is ended in the printer-side controller and the device-side controller, the printer-side controller and the device-side controller perform the identifier associating process again.

6. The printer system according to claim 1, further comprising a connection status detector configured to detect a connection status between the printer-side connector and the device-side second connector, and a connection status between the device-side first connector of the connectable device connected to the printer and the device-side second connector, wherein the printer-side controller and the device-side controller perform the identifier associating process when the connection status detector detects a change in the connection status.

7. The printer system according to claim 1, further comprising a connection status detector configured to detect a connection status between the printer-side connector and the device-side second connector, and a connection status between the device-side first connector of the connectable device connected to the printer and the device-side second connector, wherein the printer-side controller or the device-side controller performs the identifier associating process when the connection status detector detects a change in the connection status.

8. A printer system comprising a printer and a plurality of connectable devices, the printer comprising:

a printer-side connector configured to connect any of the connectable devices;

a printer-side communication interface configured to communicate with the connectable devices;

a printer-side identifier storage memory configured to store an identifier for each of the connectable devices and stage position information associated with the identifier, the stage position information being indicative of a position of one of the connectable devices with the corresponding identifier, in the plurality of connectable devices serially connected; and a printer-side controller, the connectable devices being serially connected to the printer in multiple stages, each of the connectable devices having a common function and comprising:

a device-side first connector configured to connect another one of the connectable devices;

a device-side second connector configured to connect one of the printer-side connector and the device-side first connector of another connectable device;

a device-side identifier storage memory configured to store the identifier;

a device-side communication interface configured to communicate with the printer or another connectable device; and a device-side controller, the printer-side controller being configured so as to perform, as an identifier associating process, a process such that the printer-side communication interface is controlled to perform a printer-side common permission data transmission process which transmits to one of the connectable devices via the printer-side connector common permission data which is common among the connectable devices having the common device function, after the printer-side common permission data transmission process is performed, the printer-side communication interface is controlled so as to repeat a printer-side connection confirmation data transmission process while a printer-side reception process is performed, the printer-side connection confirmation data transmission process being a process of transmitting, to all the connectable devices, connection confirmation data for confirming a connection status with each of the connectable devices, the printer-side reception process being a process of receiving response data transmitted from the connectable devices in response to the printer-side connection confirmation data transmission process, the device-side controller being configured so as to perform, as the identifier associating process, a process such that the device-side communication interface is controlled so as to perform a device-side connection confirmation data reception process of receiving the connection confirmation data from the printer, the device-side communication interface is controlled so as to perform a device-side common permission data reception process of receiving the common permission data via the device-side second connector, the device-side communication interface is controlled so that, if the common permission data has been already received in the device-side common permission data reception process at a time of receiving the connection confirmation data in the device-side connection confirmation data reception process, a device-side transmission process and a forwarding process are performed, the device-side transmission process being a process of transmitting the response data for the connection confirmation data to the printer, and the forwarding process being a process of transferring the common permission data to another one of the connectable devices connected via the device-side first connector are performed, the printer-side controller and the device-side controller further being configured so as to perform, as the identifier associating process, a process such that when the printer-side controller confirms connection with any one of the connectable devices through the printer-side reception process, the printer-side controller stores in the printer-side identifier storage memory the identifier and the position of that connectable devices for which connection has been confirmed, or the device-side controller of the connectable device for which connection has been confirmed stores in its device-side identifier storage memory the identifier corresponding to the position of that connectable device, which is stored in the printer-side identifier storage memory of the printer.

9. The printer system according to claim 8, wherein the device-side identifier storage memory of each connectable device stores in advance a unique identifier of the connectable device;

at a time of causing the device-side communication interface to perform the device-side transmission process, the device-side controller of each connectable device adds the identifier stored in the device-side identifier storage memory to the response data to be transmitted to the printer through the device-side transmission process; and when the response data transmitted from the connectable device is received in response to an n-th (where n is a natural number) printer-side connection confirmation data transmission process, in the printer-side reception process of the printer-side communication interface, the printer-side controller of the printer stores the identifier contained in the response data in the printer-side identifier storage memory as the identifier of the connectable device of an n-th stage in the multiple stages.

10. The printer system according to claim 8, wherein the printer-side identifier storage memory of the printer stores in advance an identifier for each position of the multiple stages, when the printer-side communication interface performs an n-th (where n is a natural number) printer-side connection confirmation data transmission process, the printer-side controller of the printer adds to the connection confirmation data the identifier corresponding to the n-th stage stored in the printer-side identifier storage memory;

when the device-side communication interface performs the device-side transmission process in response to the device-side connection confirmation data reception process, the device-side controller of the connectable device stores in the device-side identifier storage memory the identifier contained in the connection confirmation data received through the device-side connection confirmation data reception process.

11. The printer system according to claim 8, wherein in data communication between the printer and any one of the connectable devices at a specific stage out of the multiple stages, after the identifier associating process is ended in the printer-side controller and the device-side controller, the printer-side controller of the printer, when transmitting data to that connectable device of the specific stage, refers to the printer-side identifier storage memory to add the identifier corresponding to the specific stage to the data to be transmitted, and transmits the data to all the connectable devices, and when receiving data from the connectable device, refers to the printer-side identifier storage memory and specify the connectable device from which the data is transmitted based on the identifier contained in the data, the device-side controller of the connectable device, when receiving data from the printer, reads the data only when the identifier contained in the data matches with the identifier stored in the device-side identifier storage memory, and when transmitting data to the printer, transmits data adding thereto the identifier stored in the device-side identifier storage memory.

12. The printer system according to claim 8, further comprising:

a plurality of connectable device groups, each group including the connectable devices serially connected to the printer in multiple stages and having the common device function, wherein the device function of the connectable devices in any one of the connectable device groups is different from that of the connectable devices in another one of the connectable device groups, the printer includes: the plurality of printer-side connectors, each configured to connect any one of the connectable devices in any one of the connectable device groups;

a connection line configured to connect the printer-side connectors; and a main body side permission data storage memory configured to store the common permission data which is different among the connectable device groups, each of the connectable devices further includes a device-side permission data storage memory for storing the common permission data which is common among the connectable devices within a single connectable device group, the printer-side controller of the printer controls the printer-side communication interface so as to transmit to the connectable devices of all the connectable device groups the connection confirmation data in the printer-side connection confirmation data transmission process, controls the printer-side communication interface so that, after the printer-side common permission data transmission process, a process operation of repeating the printer-side connection confirmation data transmission process while the printer-side reception process is performed is repeated, changing the common permission data to be transmitted via the printer-side connector in the printer-side common permission data transmission process, until the process operation is performed for all common permission data stored in the device-side permission data storage memory;

the device-side controller of each connectable device, when the connection confirmation data is received in the device-side connection confirmation data reception process, performs the device-side transmission process and the forwarding process corresponding to the connection confirmation data, if data matching with the common permission data stored in the device-side permission data storage memory has been received in the device-side common permission data reception process.

13. The printer system according to claim 8, wherein when a predetermined period elapses after the identifier associating process is ended in the printer-side controller and the device-side controller, the printer-side controller and the device-side controller perform the identifier associating process again.

14. A printer for use in a printer system comprising the printer and a plurality of connectable devices having a common device function, which are serially connected to the printer in multiple stages, each of the connectable devices comprising: a device-side first connector configured to connect another one of the connectable devices; a device-side second connector configured to connect one of a printer-side connector of the printer and the device-side first connector of another one of the connectable devices; a device-side identifier storage memory configured to store an identifier for each of the connectable devices; a device-side communication interface configured to perform a device-side connection confirmation data reception process of receiving, via the device-side second connector, connection confirmation data transmitted from the printer for confirming connection status between the printer and the connectable device, a device-side transmission process of transmitting response data to the printer in response to the connection confirmation data, a forwarding process of forwarding the connection confirmation data to another one of the connectable devices being connected via the device-side first connector; and a device-side controller, the device-side controller controlling the device-side communication interface so as to perform, as an identifier associating process, the forwarding process of the connection confirmation data received in the device-side connection confirmation data reception process after the device-side transmission process, the printer, comprising:

a printer-side communication interface configured to communicate with the connectable devices;

a printer-side identifier storage memory configured to store the identifier for each of the connectable devices and stage position information associated with the identifier, the stage position information being indicative of a position of one of the connectable devices with the corresponding identifier, in the plurality of connectable devices serially connected; and a printer-side controller;

the printer-side controller being configured so as to perform, as the identifier associating process, a process such that the printer-side communication interface is controlled so as to repeat a printer-side connection confirmation data transmission process while a printer-side reception process is performed, the printer-side connection confirmation data transmission process being a process of transmitting the connection confirmation data to the connectable device via the printer-side connector, the printer-side reception process being a process of receiving, via the printer-side connector, response data transmitted from the connectable devices in response to the printer-side connection confirmation data transmission process, and when the printer-side controller confirms connection with any one of the connectable devices through the printer-side reception process, the printer-side controller stores in the printer-side identifier storage memory the identifier and the position of that connectable devices for which connection has been confirmed.

15. A connectable device for use in a printer system comprising a plurality of connectable devices and a printer capable of serially connecting thereto the connectable devices in multiple stages, the printer comprising: a printer-side connector configured to connect any of the connectable devices; a printer-side communication interface configured to perform a printer-side connection confirmation data transmission process of transmitting, to the connectable devices via the printer-side connector, connection confirmation data for confirming a connection status with each of the connectable devices, and a printer-side reception process of receiving, via the printer-side connector, response data transmitted from the connectable devices in response to the printer-side connection confirmation data transmission process; a printer-side identifier storage memory configured to store an identifier for each of the connectable devices and stage position information associated with the identifier, the stage position information being indicative of a position of one of the connectable devices with the corresponding identifier, in the plurality of connectable devices serially connected; and a printer-side controller, the printer-side controller controlling the printer-side communication interface, as the identifier associating process, so as to repeat the printer-side connection confirmation data transmission process while the printer-side reception process is performed, and when a connection with any one of the connectable devices is confirmed through the printer-side reception process, cause the printer-side identifier storage memory to store the identifier and the position of the connectable device for which the connection is confirmed, the connectable device having a common device function and, comprising:

a device-side first connector configured to connect another one of the connectable devices;

a device-side second connector configured to connect one of the printer-side connector and the device-side first connector of another connectable device;

the device-side identifier storage memory configured to store the identifier;

a device-side communication interface configured to communicate with the printer or another connectable device; and a device-side controller, the device-side controller being configured so as to perform, as an identifier associating process, a process such that the device-side controller controls the device-side communication interface so as to, after transmitting the response data to the printer in response to the connection confirmation data, forward the connection confirmation data received from the printer via the device-side second connector to another connectable device via the device-side first connector.

* * * * *